US010018934B2

(12) United States Patent
Yamada et al.

(10) Patent No.: US 10,018,934 B2
(45) Date of Patent: Jul. 10, 2018

(54) ELECTROPHOTOGRAPHIC MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masaki Yamada, Mishima (JP); Sosuke Yamaguchi, Yokohama (JP); Hideya Arimura, Suntou-gun (JP); Kazuhiro Yamauchi, Suntou-gun (JP); Satoru Nishioka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 248 days.

(21) Appl. No.: 14/973,545

(22) Filed: Dec. 17, 2015

(65) Prior Publication Data

US 2016/0187801 A1 Jun. 30, 2016

(30) Foreign Application Priority Data

Dec. 26, 2014 (JP) ..... 2014-266046

(51) Int. Cl.

| | |
|---|---|
| ***G03G 15/02*** | (2006.01) |
| ***G03G 15/08*** | (2006.01) |
| ***G03G 15/16*** | (2006.01) |
| ***G03G 21/00*** | (2006.01) |

(52) U.S. Cl.

CPC ..... *G03G 15/0233* (2013.01); *G03G 15/0818* (2013.01); *G03G 15/162* (2013.01); *G03G 21/0017* (2013.01); *G03G 2221/18* (2013.01)

(58) Field of Classification Search

CPC ..... C07D 233/60; G03G 15/0233; G03G 15/0818; G03G 15/162

See application file for complete search history.

(56) References Cited

U.S. PATENT DOCUMENTS

| | | | |
|---|---|---|---|
| 8,628,854 | B2 | 1/2014 | Yamauchi et al. |
| 8,771,818 | B2 | 7/2014 | Nishioka et al. |
| 8,846,287 | B2 | 9/2014 | Yamada et al. |
| 8,867,972 | B2 | 10/2014 | Suzuki et al. |
| 8,913,931 | B2 | 12/2014 | Hayashi et al. |
| 9,086,643 | B2 | 7/2015 | Kikuchi et al. |
| 9,556,359 | B2 | 1/2017 | Suzumura et al. |

(Continued)

FOREIGN PATENT DOCUMENTS

| | | |
|---|---|---|
| CN | 103038710 | 4/2013 |
| CN | 103443715 | 12/2013 |

(Continued)

OTHER PUBLICATIONS

Machine translation of JP 2011-118113A (Year: 2011).*

(Continued)

*Primary Examiner* — Ramsey E Zacharia

(74) *Attorney, Agent, or Firm* — Fitzpatrick Cella Harper and Scinto

(57) ABSTRACT

Provided is an electrophotographic member capable of forming a high-quality electrophotographic image. The electrophotographic member includes an electroconductive substrate and an electroconductive resin layer on the electroconductive substrate, in which the electroconductive resin layer contains a resin having, in the molecule, a specific cation structure, and a specific anion.

13 Claims, 3 Drawing Sheets

(56) References Cited

U.S. PATENT DOCUMENTS

| | | | | |
|---|---|---|---|---|
| 9,599,913 | B2 | 3/2017 | Nishioka et al. | |
| 9,639,009 | B2 * | 5/2017 | Yamaguchi | G03G 5/043 |
| 2012/0281998 | A1 | 11/2012 | Kikuchi et al. | |
| 2014/0221184 | A1 | 8/2014 | Arimura et al. | |
| 2014/0287899 | A1 | 9/2014 | Nishioka et al. | |
| 2015/0198900 | A1 | 7/2015 | Yamada et al. | |
| 2015/0331340 | A1 | 11/2015 | Nishioka et al. | |
| 2015/0331341 | A1 | 11/2015 | Yamaguchi et al. | |
| 2015/0331342 | A1 | 11/2015 | Yamaguchi et al. | |
| 2015/0331347 | A1 | 11/2015 | Arimura et al. | |

FOREIGN PATENT DOCUMENTS

| | | | |
|---|---|---|---|
| CN | 103502893 | | 1/2014 |
| CN | 104204961 | | 12/2014 |
| CN | 105093875 | A | 11/2015 |
| EP | 2 950 154 | A1 | 12/2015 |
| JP | 57-5047 | A | 1/1982 |
| JP | 4392745 | B2 | 1/2010 |
| JP | 2011-118113 | A | 6/2011 |
| WO | 2014/091745 | | 6/2014 |

OTHER PUBLICATIONS

U.S. Appl. No. 14/973,505, filed Dec. 17, 2015, Inventor(s): Yamaguchi et al.
European Search Report dated Apr. 5, 2016 in European Application No. 15202288.5.

* cited by examiner

ELECTROPHOTOGRAPHIC MEMBER, PROCESS CARTRIDGE, AND ELECTROPHOTOGRAPHIC APPARATUS

BACKGROUND OF THE INVENTION

Field of the Invention

The present invention relates to an electrophotographic member to be used in an electrophotographic apparatus, and a process cartridge and an electrophotographic apparatus each including the electrophotographic member.

Description of the Related Art

In an electrophotographic image forming apparatus (such as a copying machine, facsimile, or printer employing an electrophotographic system), an electrophotographic photosensitive member (hereinafter sometimes referred to as "photosensitive member") is charged by a charging unit and exposed by a laser or the like, and as a result, an electrostatic latent image is formed on the photosensitive member. Next, toner in a developer container is applied onto a toner carrier by a toner-supplying roller and a toner layer thickness-regulating member. The electrostatic latent image on the photosensitive member is developed with the toner conveyed to a developing region by the toner carrier at a portion in which the photosensitive member and the toner carrier are in contact with, or close to, each other. After that, the toner on the photosensitive member is transferred onto recording paper by a transfer unit, and is fixed by heat and pressure. The toner remaining on the photosensitive member is removed by a cleaning blade.

In the electrophotographic image forming apparatus, an electrophotographic member including an electroconductive base material and an electroconductive resin layer on the base material is used as a member such as the toner carrier, a charging member, the toner-supplying roller, the cleaning blade, or the toner layer thickness-regulating member. In some cases, the electroconductive resin layer in such electrophotographic member has added thereto an ionic electroconductive agent, such as a quaternary ammonium salt compound, in order to control its electrical resistance value to from $10^5\Omega$ to $10^9\Omega$.

However, the electrical resistance value of the electroconductive resin layer having electroconductivity imparted thereto by the ionic electroconductive agent is liable to fluctuate depending on its surrounding environment. Specifically, its electrical resistance value under a normal-temperature environment having, for example, a temperature of 23° C., and its electrical resistance value under a low-temperature and low-humidity environment having, for example, a temperature of 0° C. significantly differ from each other in some cases.

As a measure against such problem, in Japanese Patent No. 4392745, there is a disclosure of a method involving using an ionic liquid having a specific chemical structure for a rubber composition. In addition, in Japanese Patent Application Laid-Open No. 2011-118113, there is a disclosure of a method involving using an ionic liquid having a hydroxy group in a urethane resin composition.

SUMMARY OF THE INVENTION

According to one embodiment of the present invention, there is provided an electrophotographic member, including:

an electroconductive substrate; and an electroconductive resin layer on the electroconductive substrate, in which the electroconductive resin layer contains:

a resin having, in a molecule, at least one cation structure selected from the group consisting of the following formulae (1) to (13) and (29); and an anion, and in which the anion includes at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion.

(1)

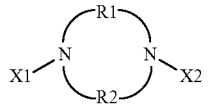

(2)

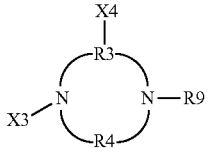

(3)

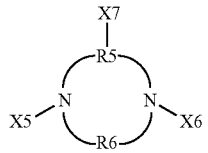

(4)

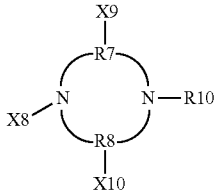

In the formulae (1) to (4):

R1 to R8 each independently represent a hydrocarbon group needed for a nitrogen-containing heterocycle in each of the formulae (1) to (4) to form a five-membered ring, a six-membered ring, or a seven-membered ring;

R9 and R10 each independently represent a hydrogen atom or a hydrocarbon group having 1 or more and 4 or less carbon atoms; and one of two N's represents $N^+$.

(5)

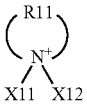

(6)

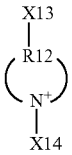

-continued (7)

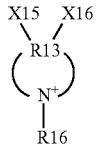

(8)

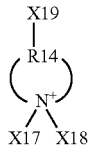

(9)

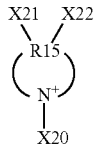

In the formulae (5) to (9):

R11 to R15 each independently represent a hydrocarbon group needed for a nitrogen-containing heterocycle in each of the formulae (5) to (9) to form a five-membered ring, a six-membered ring, or a seven-membered ring; and R16 represents a hydrogen atom or a hydrocarbon group having 1 or more and 4 or less carbon atoms.

(10)

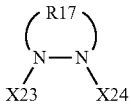

(11)

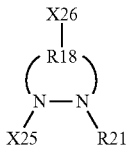

(12)

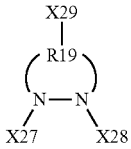

(13)

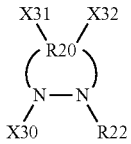

(29)

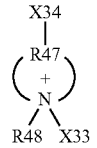

In the formulae (10) to (13) and (29), R17 to R20 and R47 each independently represent a hydrocarbon group needed for a nitrogen-containing heterocycle in each of the formulae (10) to (13) and (29) to form a five-membered ring, a six-membered ring, or a seven-membered ring.

R21, R22, and R48 each independently represent a hydrogen atom or a hydrocarbon group having 1 or more and 4 or less carbon atoms. In the formulae (10) to (13), one of two N's represents $N^+$.

In the formulae (1) to (13) and (29), X1 to X34 each independently represent a structure represented by the following formula (A), (b), or (c).

Formula (A)

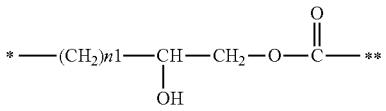

Formula (b)

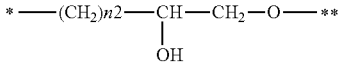

Formula (c)

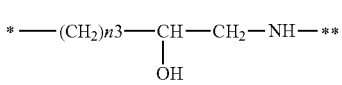

In the formula (A), (b), or (c):

symbol "*" represents a bonding site with a nitrogen atom in the nitrogen-containing heterocycle or a carbon atom in the nitrogen-containing heterocycle in the formulae (1) to (13) and (29);

symbol "**" represents a bonding site with a carbon atom in a polymer chain of the resin; and n1, n2, and n3 each independently represent an integer of 1 or more and 4 or less.

According to another embodiment of the present invention, there is provided an electrophotographic member, including:

an electroconductive substrate; and an electroconductive resin layer on the electroconductive substrate, in which the electroconductive resin layer contains a resin including a reaction product between an ionic compound having at least one cation selected from the group consisting of the following formulae (14) to (26) and (28), and a compound capable of reacting with a glycidyl group.

(14)

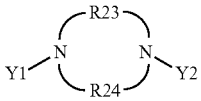

(15)

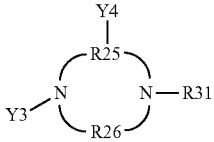

(16)

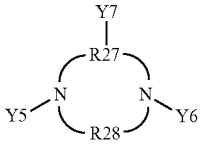

-continued (17)

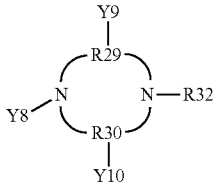

In the formulae (14) to (17):

R23 to R30 each independently represent a hydrocarbon group needed for a nitrogen-containing heterocycle in each of the formulae (14) to (17) to form a five-membered ring, a six-membered ring, or a seven-membered ring;

R31 and R32 each independently represent a hydrogen atom or a hydrocarbon group having 1 or more and 4 or less carbon atoms; and one of two N's represents $N^+$.

(18)

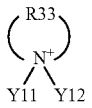

(19)

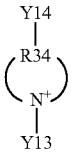

(20)

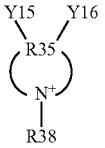

(21)

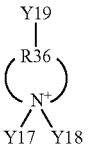

(22)

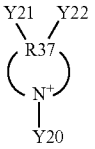

In the formulae (18) to (22):

R33 to R37 each independently represent a hydrocarbon group needed for a nitrogen-containing heterocycle in each of the formulae (18) to (22) to form a five-membered ring, a six-membered ring, or a seven-membered ring; and R38 represents a hydrogen atom or a hydrocarbon group having 1 or more and 4 or less carbon atoms.

(23)

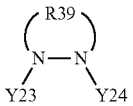

-continued (24)

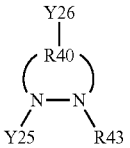

(25)

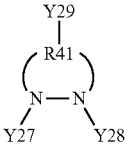

(26)

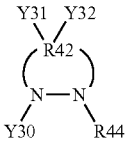

(28)

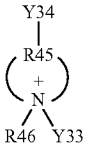

In the formulae (23) to (26) and (28), R39 to R42 and R45 each independently represent a hydrocarbon group needed for a nitrogen-containing heterocycle in each of the formulae (23) to (26) and (28) to form a five-membered ring, a six-membered ring, or a seven-membered ring.

R43, R44, and R46 each independently represent a hydrogen atom or a hydrocarbon group having 1 or more and 4 or less carbon atoms. In the formulae (23) to (26), one of two N's represents $R^+$.

In the formulae (14) to (26) and (28), Y1 to Y34 each independently represent a structure represented by the following formula (27).

(27)

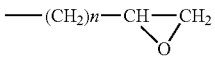

In the formula (27), n represents an integer of 1 or more and 4 or less.

According to another embodiment of the present invention, there is provided a process cartridge, which is removably mounted onto a main body of an electrophotographic apparatus, the process cartridge including at least one electrophotographic member including the above-mentioned electrophotographic member.

According to another embodiment of the present invention, there is provided an electrophotographic apparatus, including: an electrophotographic photosensitive member; and at least one electrophotographic member including the above-mentioned electrophotographic member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In recent years, an electrophotographic image forming apparatus has been required to be capable of maintaining high image quality and high durability under a more severe environment. Incidentally, an electroconductive layer containing an ionic liquid is excellent in suppression of a fluctuation in resistance depending on an environment, but in some cases, the ionic liquid cannot allow a resin layer to have sufficient electroconductivity under an environment having an extremely low temperature of, for example, 0° C. According to investigations made by the inventors of the present invention, in the environment having an extremely low temperature as described above, even the ionic liquid disclosed in Japanese Patent No. 4392745 or the composition disclosed in Japanese Patent Application Laid-Open No. 2011-118113 underwent an increase in electrical resistance, resulting in a defect on an electrophotographic image in some cases.

The inventors of the present invention have made extensive investigations in order to solve the above-mentioned problem. As a result, the inventors have found that a resin layer containing a resin having a specific cation structure in the molecule, and a specific anion can keep a difference small from an electrical resistance value under a normal-temperature and normal-humidity environment, even under an environment having an extremely low temperature, such as 0° C.

[Electrophotographic Member]

Figure 1A:
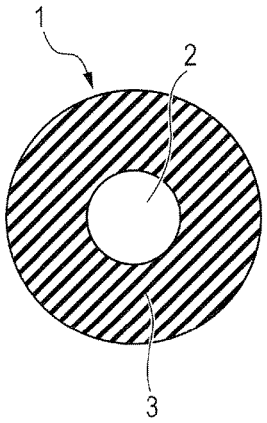
FIG. 1A, FIG. 1B, and FIG. 1C are sectional views for illustrating an example of an electrophotographic member according to the present invention.
Figure 1B:
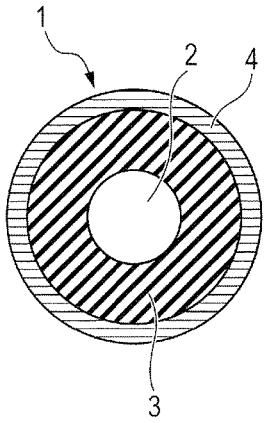

An electrophotographic member according to the present invention includes an electroconductive substrate and an electroconductive resin layer on the electroconductive substrate. An electrophotographic member according to one embodiment of the present invention, which is used as an electroconductive roller, is illustrated in each of FIG. 1A, FIG. 1B, and FIG. 1C. As illustrated in FIG. 1A, an electrophotographic member 1 according to the present invention may include an electroconductive substrate 2 and an elastic layer 3 formed on the outer periphery of the electroconductive substrate 2. In this case, the elastic layer 3 is the electroconductive resin layer according to the present invention. In addition, as illustrated in FIG. 1B, a surface layer 4 may be formed on the surface of the elastic layer 3. In this case, the electroconductive resin layer according to the present invention may be applied as any of the elastic layer 3 and the surface layer 4.

Figure 1C:
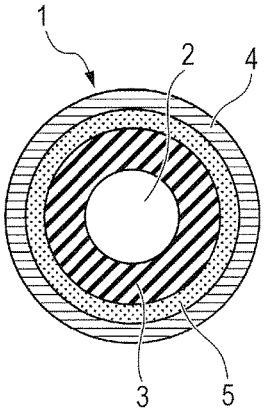

Further, as illustrated in FIG. 1C, the electrophotographic member 1 according to the present invention may have a three-layer structure in which an intermediate layer 5 is arranged between the elastic layer 3 and the surface layer 4, or a multi-layer construction in which a plurality of intermediate layers 5 are arranged. In this case, the electroconductive resin layer according to the present invention may be applied as any of the elastic layer 3, the intermediate layer 5, and the surface layer 4.

<Electroconductive Substrate>

The electroconductive substrate 2 may be a solid columnar or hollow cylindrical electroconductive substrate which functions as an electrode and support member for the electrophotographic member 1. The electroconductive substrate 2 is formed of, for example, an electroconductive material, such as: a metal or an alloy like aluminum, a copper alloy, or stainless steel; iron subjected to plating treatment with chromium or nickel; or a synthetic resin having electroconductivity.

<Elastic Layer>

The elastic layer 3 imparts, to the electrophotographic member 1, elasticity needed for forming a predetermined nip in an abutting portion between the electrophotographic member 1 and a photosensitive member.

It is preferred that the elastic layer 3 be formed of a molded product of a rubber material when the elastic layer 3 is not the electroconductive resin layer according to the present invention. Examples of the rubber material include an ethylene-propylene-diene copolymerized rubber, an acrylonitrile-butadiene rubber, a chloroprene rubber, a natural rubber, an isoprene rubber, a styrene-butadiene rubber, a fluororubber, a silicone rubber, an epichlorohydrin rubber, and a urethane rubber. One kind of those materials may be used alone, or two or more kinds thereof may be used as a mixture. Of those, a silicone rubber is particularly preferred from the viewpoints of compression set and flexibility. The silicone rubber is, for example, a cured product of an addition-curable silicone rubber.

As a method of forming the elastic layer 3, there is given mold molding using a liquid material, or extrusion molding using a kneaded rubber.

Various additives, such as an electroconductivity-imparting agent, a non-electroconductive filler, a crosslinking agent, and a catalyst, are each appropriately blended into the elastic layer 3. Fine particles of carbon black, of an electroconductive metal, such as aluminum or copper, or of an electroconductive metal oxide, such as tin oxide or titanium oxide, may be used as the electroconductivity-imparting agent to be added in order to allow the elastic layer to function as an electroconductive layer. Of those, carbon black is particularly preferred because the carbon black is relatively easily available and provides good electroconductivity. When the carbon black is used as the electroconductivity-imparting agent, the carbon black is blended in an amount of from 2 parts by mass to 50 parts by mass with respect to 100 parts by mass of the rubber in the rubber material. Examples of the non-electroconductive filler include silica, quartz powder, titanium oxide, and calcium carbonate. Examples of the crosslinking agent include di-t-butyl peroxide, 2,5-dimethyl-2,5-di(t-butylperoxy)hexane, and dicumyl peroxide. One kind of those additives may be used alone, or two or more kinds thereof may be used in combination.

When the elastic layer 3 is the electroconductive resin layer according to the present invention, a resin layer to be described below is used for the elastic layer 3.

<Electroconductive Resin Layer>

In the present invention, the electroconductive resin layer contains: a resin having, in the molecule, at least one cation structure selected from the group consisting of the formulae (1) to (13) and (29); and an anion, and the anion is at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion.

(Description of Chemical Structure and Bonding Mode)

The resin according to the present invention is obtained by, for example, allowing an ionic compound formed of a nitrogen-containing heterocyclic cation having at least two glycidyl groups and the above-mentioned anion to react with a compound capable of reacting with a glycidyl group. Specifically, the resin according to the present invention is obtained by a reaction between an ionic compound having at least one cation selected from the group consisting of the formulae (14) to (26) and (28), and the compound capable of reacting with a glycidyl group.

The inventors of the present invention presume as follows with regard to the reason why the effect of the present invention is achieved by virtue of the presence of the electroconductive resin layer containing the resin having, in the molecule, at least one cation structure selected from the group consisting of the formulae (1) to (13) and (29), and the anion according to the present invention. In general, in a low temperature range, a "rate of ionization", at which a cation and an anion are present as a cation and an anion instead of forming a "salt" through ionic bonding, tends to reduce, resulting in a reduction in electroconductivity. Accordingly, the rate of ionization needs to be increased on both the cation side and the anion side.

(Reason for Achievement of Effect of the Present Invention by Cation Structure of the Present Invention)

In the present invention, the resin has a feature of having at least two hydroxy groups in the vicinity of a cation moiety in a nitrogen-containing heterocyclic structure. The hydroxy groups are derived from reaction residues of glycidyl groups of the cation. The plurality of hydroxy groups present in the vicinity of the cation contribute to the stability of the positive charge of the cation by virtue of the unshared electron pairs of oxygen atoms. In the cation structure according to the present invention, at least two hydroxy groups are involved in the stabilization of one cation, and hence a higher rate of ionization can be achieved.

In addition, as compared to a quaternary ammonium salt-type cation having no nitrogen-containing heterocyclic structure, the cation having a nitrogen-containing heterocyclic structure causes steric hindrance which reduces accessibility to the anion by virtue of the ring structure containing a nitrogen atom, and thus its interaction with the anion is physically reduced. In the cation structure contained in the resin according to the present invention, the cation charge is stabilized by the plurality of hydroxy groups derived from glycidyl groups as well as the nitrogen-containing heterocyclic structure having a reduced interaction with the anion. Probably as a result of this, the rate of ionization on the cation side is increased and high electroconductivity is exhibited even at low temperature.

(Reason for Selecting Anion According to the Present Invention)

Further, the anion according to the present invention is chemically extremely stable and has a high rate of ionization by virtue of its chemical structure, as compared to a halogen anion, a sulfate anion, or a nitrate anion. That is, the anion has a strong electron-withdrawing group in the molecule, which stabilizes the negative charge of the anion. Probably as a result of this, the anion exhibits a high rate of ionization in a wide temperature range and contributes to the expression of high electroconductivity even at low temperature. In the present invention, it is considered that high electroconductivity is exhibited even at low temperature by virtue of the combination of the cation and the anion.

(Description of Cation Structure)

The cation structure according to the present invention is at least one selected from the group consisting of the formulae (1) to (13) and (29).

(1)

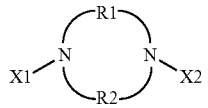

(2)

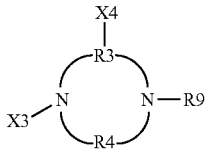

(3)

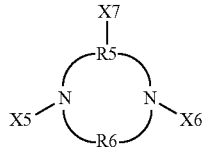

(4)

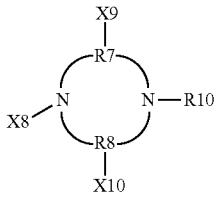

(5)

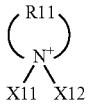

(6)

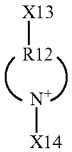

(7)

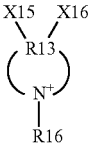

(8)

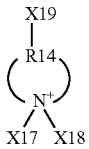

(9)

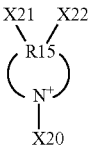

-continued (10)

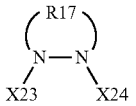

(11)

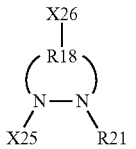

(12)

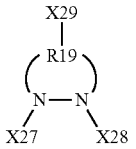

(13)

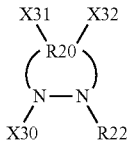

(29)

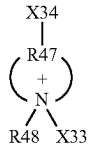

In the formulae (1) to (13) and (29), R1 to R8, R11 to R15, R17 to R20, and R47 each independently represent a hydrocarbon group needed for the nitrogen-containing heterocycle in each of the formulae to form a five-membered ring, a six-membered ring, or a seven-membered ring. As a five-membered nitrogen-containing heterocycle, there are given, for example, imidazolium, imidazolinium, pyrazolium, pyrazolinium, and pyrrolidinium. As a six-membered nitrogen-containing heterocycle, there are given, for example, pyridinium, pyrimidinium, pyrazinium, pyridazinium, piperidinium, and piperazinium. As a seven-membered nitrogen-containing heterocycle, there are given, for example, azepinium, azepanium, diazepinium, and diazepanium. Of those, from the viewpoint of the electroconductivity of the electroconductive resin layer at low temperature, a five-membered or six-membered, nitrogen-containing heterocycle is preferred, and imidazolium or pyridinium is more preferred.

In the formulae (1) to (13) and (29), R9, R10, R16, R21, R22 and R48 each independently represent a hydrogen atom or a hydrocarbon group having 1 or more and 4 or less carbon atoms. Of those, a hydrogen atom or a methyl group is preferred.

In the formulae (1) to (13) and (29), X1 to X34 each independently represent a structure represented by the following formula (A), (b), or (c).

Formula (A)

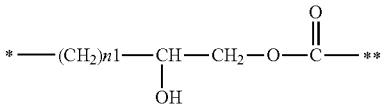

-continued

Formula (b)

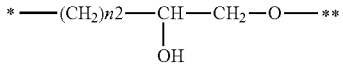

Formula (c)

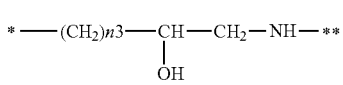

In the formula (A), (b), or (c), symbol "*" represents a bonding site with a nitrogen atom in the nitrogen-containing heterocycle or a carbon atom in the nitrogen-containing heterocycle in the formulae (1) to (13) and (29). In addition, symbol "**" represents a bonding site with a carbon atom in a polymer chain of the resin according to the present invention. n1, n2, and n3 in the formula (A), (b), or (c) each represent the number of carbon atoms corresponding to bonding sites between a glycidyl group and the nitrogen-containing heterocycle, and from the viewpoint of the stabilization of the positive charge of the cation by a hydroxy group to be generated after a reaction, n1, n2, and n3 are each set to 1 or more and 4 or less. When n1 to n3 represent 4 or less, the distance between the hydroxy group to be generated and the nitrogen-containing heterocycle serving as the cation moiety is small, and hence sufficient stabilization of the positive charge of the cation is obtained.

The resin having a cation structure represented by any one of the formulae (1) to (13) and (29) is obtained by a reaction between at least one cation selected from the group consisting of the formulae (14) to (26) and (28), and the compound capable of reacting with a glycidyl group.

That is, the cation structures represented by the formulae (1) to (13) and (29) correspond to the cations represented by the formulae (14) to (26) and (28), respectively. It should be noted that in the formulae (14) to (17) and the formulae (23) to (26), $N^+$ is not specifically shown but one of the two N's represents $N^+$ as in the formulae (1) to (4) and the formulae (10) to (13).

(14)

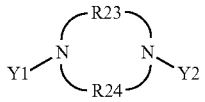

(15)

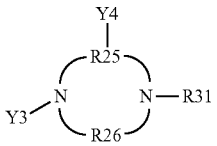

(16)

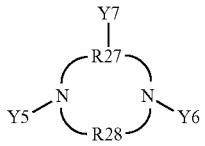

(17)

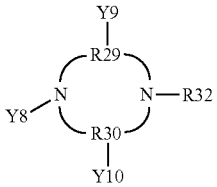

-continued (18)

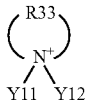

(19)

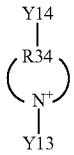

(20)

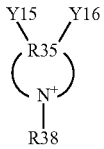

(21)

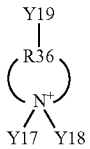

(22)

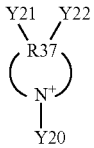

(23)

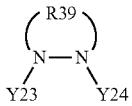

(24)

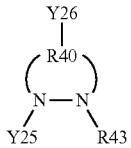

(25)

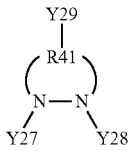

(26)

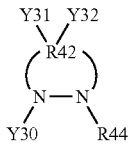

(28)

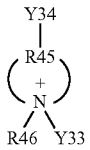

In the formulae (14) to (26) and (28), R23 to R30 each independently represent a hydrocarbon group needed for the nitrogen-containing heterocycle in each of the formulae (14) to (17) to form a five-membered ring, a six-membered ring, or a seven-membered ring. R31 and R32 each independently represent a hydrogen atom or a hydrocarbon group having 1 or more and 4 or less carbon atoms.

In the formulae (18) to (22), R33 to R37 each independently represent a hydrocarbon group needed for the nitrogen-containing heterocycle in each of the formulae (18) to (22) to form a five-membered ring, a six-membered ring, or a seven-membered ring. R38 represents a hydrogen atom or a hydrocarbon group having 1 or more and 4 or less carbon atoms.

In the formulae (23) to (26) and (28), R39 to R42 and R45 each independently represent a hydrocarbon group needed for the nitrogen-containing heterocycle in each of the formulae (23) to (26) and (28) to form a five-membered ring, a six-membered ring, or a seven-membered ring.

R43, R44, and R46 each independently represent a hydrogen atom or a hydrocarbon group having 1 or more and 4 or less carbon atoms.

In the formulae (14) to (26) and (28), Y1 to Y34 each independently represent a structure represented by the formula (27), and in the formula (27), n represents an integer of 1 or more and 4 or less for the same reason as that described above.

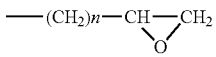

(27)

In the formulae (1) to (13) and (29), it is preferred that the number of hydroxy groups derived from glycidyl groups which the nitrogen-containing heterocycle has be 3 or more from the viewpoints of the stabilization of the positive charge of the cation, and the suppression of the bleeding out of the ionic compound. In addition, it is preferred that the resin according to the present invention have, in the molecule, at least one cation structure selected from the formulae (3), (4), (8), (9), (12), (13), and (29). In addition, it is preferred that the cation contained in the ionic compound be at least one selected from the formulae (16), (17), (21), (22), (25), (26), and (28).

The cation represented by any one of the formulae (14) to (26) and (28) may be obtained by, for example, introducing glycidyl groups into a nitrogen-containing heterocycle compound, and then performing a known quaternization reaction, such as a quaternization reaction involving using an alkyl halide.

The structures of cyclic moieties in the structures represented by the formulae (1) to (2), (5) to (8), (10), (11), and (29) are specifically exemplified by the following formulae (1-1), (2-1), (3-1), (5-1), (6-1), (7-1), (8-1), (10-1), (11-1) and (29-1), respectively.

It should be noted that X1 to X6, X11 to X18, X23 to X25, X33, X34, R9, R16, R21, and R48 in the formulae (1-1), (2-1), (3-1), (5-1), (6-1), (7-1), (8-1), (10-1), (11-1), and (29-1) have the same meanings as in the formulae (1) to (3), (5) to (8), (10), (11), and (29).

Formula (1-1)

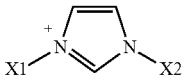

Formula (2-1)

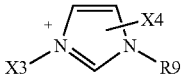

-continued

Formula (3-1)

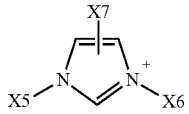

Formula (5-1)

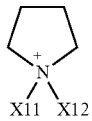

Formula (6-1)

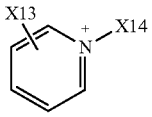

Formula (7-1)

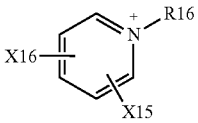

Formula (8-1)

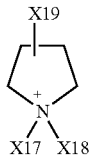

Formula (10-1)

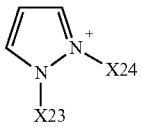

Formula (11-1)

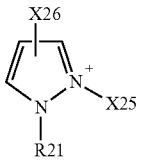

Formula (29-1)

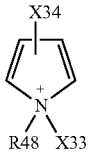

(Description of Anion)

The anion according to the present invention is at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion.

An example of the fluorinated sulfonylimide anion is a fluorosulfonylimide anion. Examples of the fluorinated alkylsulfonylimide anion include a tri fluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, and a cyclic anion, such as cyclo-hexafluoropropane-1,3-bis(sulfonyl)imide anion.

An example of the fluorinated sulfonyl methide anion is a fluorosulfonyl methide anion. Examples of the fluorinated alkylsulfonyl methide anion include a trifluoromethanesulfonyl methide anion, a perfluoroethylsulfonyl methide anion, a perfluoropropylsulfonyl methide anion, a perfluorobutylsulfonyl methide anion, a perfluoropentylsulfonyl methide anion, a perfluorohexylsulfonyl methide anion, and a perfluorooctylsulfonyl methide anion.

An example of the fluorinated sulfonate anion is a fluorosulfonate anion. Examples of the fluorinated alkylsulfonate anion include a trifluoromethanesulfonate anion, a fluoromethanesulfonate anion, a perfluoroethylsulfonate anion, a perfluoropropylsulfonate anion, a perfluorobutylsulfonate anion, a perfluoropentylsulfonate anion, a perfluorohexylsulfonate anion, and a perfluorooctylsulfonate anion.

Examples of the fluorinated carboxylate anion include a trifluoroacetate anion, a perfluoropropionate anion, a perfluorobutyrate anion, a perfluorovalerate anion, and a perfluorocaprate anion.

An example of the fluorinated borate anion is a tetrafluoroborate anion. As a fluorinated alkylborate anion, there are given a trifluoromethyltrifluoroborate anion and a perfluoroethyltrifluoroborate anion.

An example of the fluorinated phosphate anion is a hexafluorophosphate anion. As a fluorinated alkylphosphate anion, there are given a tris-trifluoromethyl-trifluorophosphate anion and a tris-perfluoroethyl-trifluorophosphate anion.

An example of the fluorinated arsenate anion is a hexafluoroarsenate anion. As a fluorinated alkylarsenate anion, there is given a trifluoromethyl-pentafluoroarsenate anion.

An example of the fluorinated antimonate anion is a hexafluoroantimonate anion. As a fluorinated alkylantimonate anion, there is given a trifluoromethyl-pentafluoroantimonate anion.

Examples of the other anion include a dicyanamide anion and a bis(oxalato)borate anion. One kind of those anions may be used alone, or two or more kinds thereof may be used in combination.

The ionic compound according to the present invention may be obtained by, for example, subjecting an alkali metal salt or an acid of the anion to an ion exchange reaction with a halide or a hydroxide of the cation according to the present invention.

(Description of Binder)

An example of the compound capable of reacting with a glycidyl group, which is to be allowed to react with the ionic compound having at least one cation selected from the group consisting of the formulae (14) to (26) and (28), may be a compound having a hydroxy group, an amino group, or a carboxyl group. A known resin may be used as the compound having a hydroxy group, an amino group, or a carboxyl group, and examples thereof include, but are not particularly limited to, the following. One kind of these compounds may be used alone, or two or more kinds thereof may be used in combination.

A urethane resin, an epoxy resin, a urea resin, a polyether resin, a polyester resin, a melamine resin, an amide resin, an imide resin, an amide imide resin, a phenol resin, a vinyl resin, a silicone resin, a fluororesin, a polyalkyleneimine resin, and an acrylic resin.

Of those, from the viewpoints of abrasion resistance and flexibility, a urethane resin or a urea resin is preferred. When the urethane resin or the urea resin is used, the resin according to the present invention may be obtained by, for example, mixing an isocyanate compound, and a polyol compound or a polyamine compound, which serve as raw materials, with the ionic compound according to the present invention, which is formed of the nitrogen-containing heterocyclic cation having at least two glycidyl groups, and the anion, followed by curing of the mixture by heating.

The isocyanate compound is not particularly limited, and the following compounds may be used: an aliphatic polyisocyanate, such as ethylene diisocyanate or 1,6-hexamethylene diisocyanate (HDI); an alicyclic polyisocyanate, such as isophorone diisocyanate (IPDI), cyclohexane 1,3-diisocyanate, or cyclohexane 1,4-diisocyanate; an aromatic isocyanate, such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, or naphthalene diisocyanate; and a copolymerized product, isocyanurate form, TMP adduct, and biuret form thereof and block forms thereof. One kind of those compounds may be used alone, or two or more kinds thereof may be used in combination. Of those, an aromatic isocyanate, such as tolylene diisocyanate, diphenylmethane diisocyanate, or polymeric diphenylmethane diisocyanate, is preferred.

Examples of the polyol compound include, but are not particularly limited to, polyether polyol, polyester polyol, polycarbonate polyol, polyurethane polyol, and acrylic polyol. One kind of those compounds may be used alone, or two or more kinds thereof may be used in combination. Of those, polyether polyol or polyester polyol is preferably used from the viewpoints of electroconductivity and flexibility. Examples of the polyether polyol include polyethylene glycol, polypropylene glycol, and polytetramethylene glycol. In addition, an example of the polyester polyol is polyester polyol obtained by a condensation reaction between a diol component, such as 1,4-butanediol, 3-methyl-1,4-pentanediol, or neopentyl glycol, or a triol component, such as trimethylolpropane, and a dicarboxylic acid, such as adipic acid, phthalic anhydride, terephthalic acid, or hexahydroxyphthalic acid. The polyether polyol and the polyester polyol may be used as a prepolymer by extending its chain in advance with an isocyanate, such as 2,4-tolylene diisocyanate (TDI), 1,4-diphenylmethane diisocyanate (MDI), or isophorone diisocyanate (IPDI), as required.

In the case of the urethane resin, higher electroconductivity is obtained when a crosslink density is reduced in order to maintain the mobility of ions, to thereby secure the free volume of a polymer chain. Thus, a urethane resin having low crystallinity using, for example, the following polyol compound is particularly preferred: polyether polyol obtained by subjecting tetrahydrofuran and 3-methyl-tetrahydrofuran to ring-opening copolymerization, or polyester polyol obtained by subjecting 3-methyl-1,5-pentanediol and a dicarboxylic acid to a condensation reaction.

Examples of the polyamine compound include, but are not particularly limited to, a polyalkylene polyamine, such as polyethyleneimine or polypropyleneimine, an acrylic polyamine, such as poly(2-aminoethyl) acrylate, poly(2-aminoethyl) methacrylate, polyacrylamide, or polymethacrylamide. One kind of those compounds may be used alone, or two or more kinds thereof may be used in combination. Of those, a polyalkylene polyamine, which is more flexible, is suitably used from the viewpoint of the mobility of ions described above.

When the resin is obtained by allowing the ionic compound having two or more glycidyl groups according to the present invention to react with the compound capable of reacting with a glycidyl group, it is preferred that the content of the ionic compound be 0.1 part by mass or more and 10 parts by mass or less with respect to 100 parts by mass of the resin, from the viewpoints of the electroconductivity of the electrophotographic member at 0° C., and the suppression of bleeding.

When the electroconductive resin layer according to the present invention is used as the surface layer 4, the surface layer 4 may contain a non-electroconductive filler, such as silica, quartz powder, titanium oxide, zinc oxide, or calcium carbonate, as required. When the surface layer 4 is formed by a method involving coating with a paint, the non-electroconductive filler functions as a film-forming aid by adding the non-electroconductive filler to the paint. The content of the non-electroconductive filler is preferably 10 mass % or more and 30 mass % or less with respect to 100 parts by mass of a resin component in the surface layer 4.

In addition, the surface layer 4 may contain an electroconductive filler as required to the extent that the effect of the present invention is not inhibited. Particles of carbon black, of an electroconductive metal, such as aluminum or copper, or of an electroconductive metal oxide, such as zinc oxide, tin oxide, or titanium oxide, may be used as the electroconductive filler. Of those, carbon black is preferred because the carbon black is relatively easily available and from the viewpoints of an electroconductivity-imparting property and a reinforcing property.

In the case of using the electrophotographic member according to the present invention as a toner carrier or a charging member, when a surface roughness is needed, particles for roughness control may be added to the surface layer 4. The volume-average particle diameter of the particles for roughness control is preferably from 3 μm to 20 μm. In addition, the addition amount of the particles for roughness control to be added to the surface layer 4 is preferably from 1 part by mass to 50 parts by mass with respect to 100 parts by mass of a resin solid content in the surface layer 4. Particles of a polyurethane resin, a polyester resin, a polyether resin, a polyamide resin, an acrylic resin, or a phenol resin may be used as the particles for roughness control. One kind of those particles may be used alone, or two or more kinds thereof may be used in combination.

A method of forming the surface layer 4 is not particularly limited, but examples thereof include spraying with a paint, dipping, and roll coating. Such dip coating method involving causing a paint to overflow from the upper end of a dipping tank as described in Japanese Patent Application Laid-Open No. S57-5047 is simple and excellent in production stability as the method of forming the surface layer 4.

The electrophotographic member according to the present invention is applicable to any one of, for example, a non-contact-type developing apparatus and a contact-type developing apparatus each using magnetic one-component toner or nonmagnetic one-component toner, and a developing apparatus using two-component toner.

[Process Cartridge]

Figure 2:
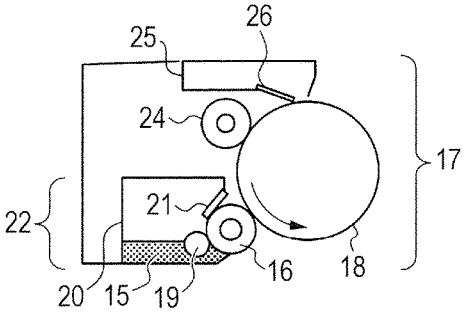
FIG. 2 is a sectional view for illustrating an example of a process cartridge according to the present invention.

A process cartridge according to the present invention is a process cartridge, which is removably mounted onto the main body of an electrophotographic image forming apparatus, the process cartridge including at least one electrophotographic member including the electrophotographic member according to the present invention. FIG. 2 is a sectional view for illustrating an example of the process cartridge according to the present invention. A process cartridge 17 illustrated in FIG. 2 is obtained by integrating a developing member 16, a developing blade 21, a developing apparatus 22, a photosensitive member 18, a cleaning blade 26, a waste toner-storing container 25, and a charging member 24, and is removably mounted onto the main body of an electrophotographic image forming apparatus. The electrophotographic member according to the present invention is applicable to, for example, the developing member 16, the developing blade 21, or the charging member 24. The developing apparatus 22 includes a toner container 20 and a toner 15 is loaded into the toner container 20. The toner 15 in the toner container 20 is supplied to the surface of the developing member 16 by a toner-supplying member 19, and a layer of the toner 15 having a predetermined thickness is formed on the surface of the developing member 16 by the developing blade 21.

[Electrophotographic Image Forming Apparatus]

Figure 3:
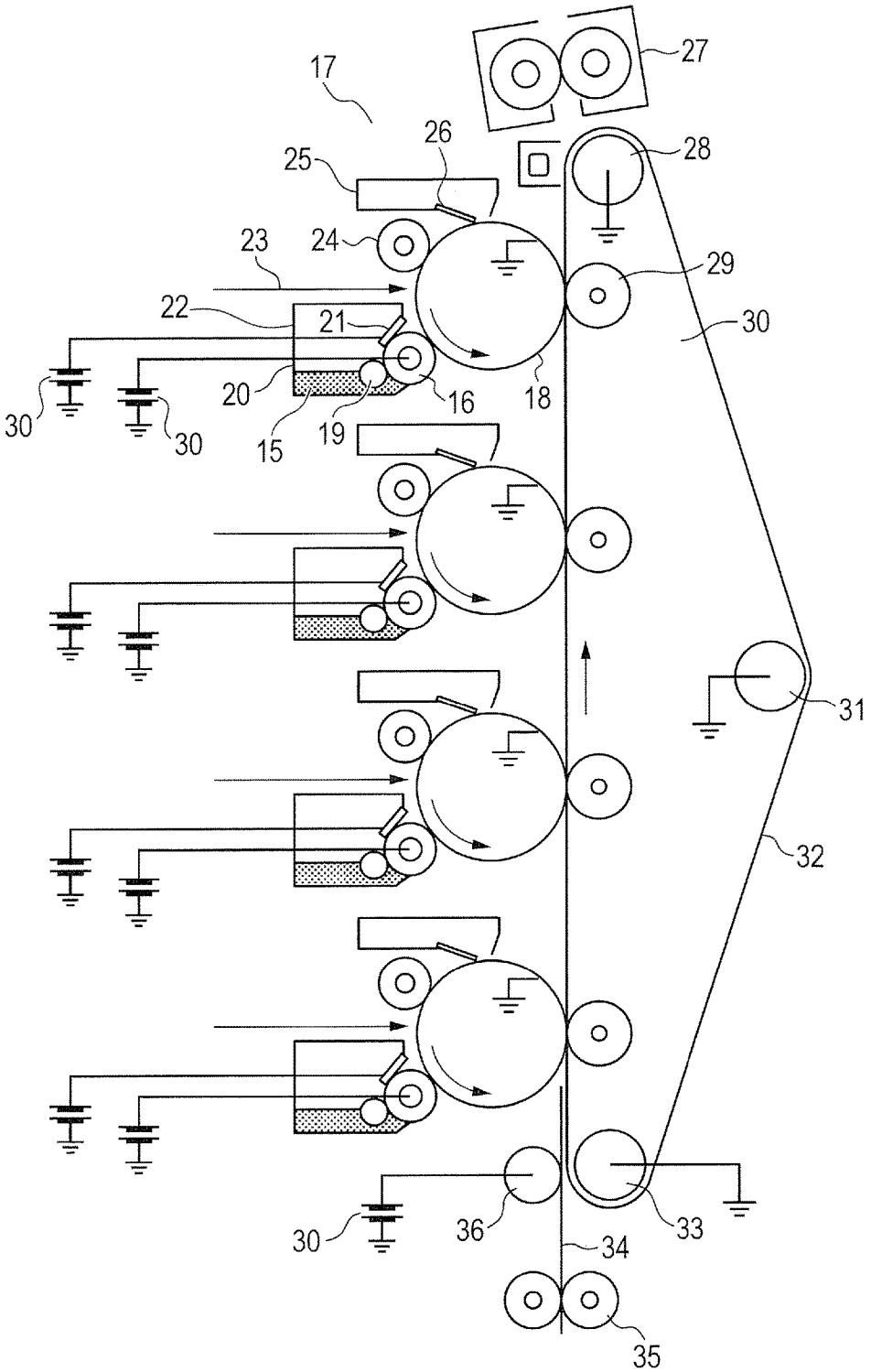
FIG. 3 is a sectional view for illustrating an example of an electrophotographic image forming apparatus according to the present invention.

An electrophotographic image forming apparatus according to the present invention is an electrophotographic image forming apparatus, including: an electrophotographic photosensitive member; and at least one electrophotographic member including the electrophotographic member according to the present invention. FIG. 3 is a sectional view for illustrating an example of an electrophotographic image forming apparatus in which the electrophotographic member according to the present invention is used as the developing member 16. Removably mounted onto the electrophotographic image forming apparatus of FIG. 3 is the developing apparatus 22 including the developing member 16, the toner-supplying member 19, the toner container 20, and the developing blade 21. Also removably mounted thereonto is the process cartridge 17 including the photosensitive member 18, the cleaning blade 26, the waste toner-storing container 25, and the charging member 24. In addition, the photosensitive member 18, the cleaning blade 26, the waste toner-storing container 25, and the charging member 24 may be provided in the main body of the electrophotographic image forming apparatus. The photosensitive member 18 rotates in a direction indicated by the arrow, and is uniformly charged by the charging member 24 for subjecting the photosensitive member 18 to charging treatment, and an electrostatic latent image is formed on the surface by laser light 23 as an exposing unit for writing the electrostatic latent image on the photosensitive member 18. The toner 15 is applied to the electrostatic latent image by the developing apparatus 22, which is placed so as to be brought into contact with the photosensitive member 18, to develop the image, whereby the image is visualized as a toner image.

The development performed here is so-called reversal development in which the toner image is formed in an exposure portion. The visualized toner image on the photosensitive member 18 is transferred onto paper 34 as a recording medium by a transfer member 29. The paper 34 is fed into the apparatus through a sheet-feeding member 35 and an adsorption member 36, and is conveyed to a gap between the photosensitive member 18 and the transfer member 29 by an endless belt-shaped transfer conveyance belt 32. The transfer conveyance belt 32 is operated by a driven member 33, a driver member 28, and a tension member 31. A voltage is applied from a bias power source 30 to each of the transfer member 29 and the adsorption member 36. The paper 34 onto which the toner image has been transferred is subjected to fixation treatment by a fixing apparatus 27 and discharged to the outside of the apparatus. Thus, a printing operation is completed.

Meanwhile, transfer residual toner remaining on the photosensitive member 18 without being transferred is scraped off by the cleaning blade 26 as a cleaning member for cleaning the surface of the photosensitive member, and is stored in the waste toner-storing container 25. The cleaned photosensitive member 18 repeatedly performs the above-mentioned operation.

The developing apparatus 22 includes: the toner container 20 storing the toner 15 as one-component toner; and the developing member 16 as a toner carrier which is positioned in an opening portion extending in a lengthwise direction in the toner container 20 and is placed so as to face the photosensitive member 18. The developing apparatus 22 can develop and visualize the electrostatic latent image on the photosensitive member 18.

According to one mode of the present invention, the electrophotographic member having a small fluctuation in electrical resistance value between a normal-temperature environment and a low-temperature environment is obtained. In addition, according to other modes of the present invention, the electrophotographic apparatus capable of stably outputting a high-quality electrophotographic image and a process cartridge to be used for the same are obtained.

Now, specific Examples and Comparative Examples according to the present invention are described.

<Synthesis of Ionic Compound>

(Synthesis of Ionic Compound IP-1)

50.0 g of imidazole (manufactured by Tokyo Chemical Industry Co., Ltd.) serving as a cation raw material was dissolved in 50.0 g of dichloromethane. To this solution, a solution of 74.8 g of chloromethyloxirane (manufactured by Tokyo Chemical Industry Co., Ltd.) serving as a tertiarizing agent dissolved in 50.0 g of dichloromethane was added dropwise under room temperature over 30 minutes, and the mixture was heated to reflux for 4 hours. Next, the reaction solution was cooled to room temperature, and 200 ml of a 5 mass % aqueous solution of sodium carbonate was added. The mixture was stirred for 30 minutes and then subjected to liquid separation, and the dichloromethane layer was washed twice with 120 g of ion-exchanged water. Next, dichloromethane was removed by evaporation under reduced pressure to provide a residue.

Subsequently, the resultant residue was dissolved in 70.0 g of acetonitrile, and 74.8 g of chloromethyloxirane (manufactured by Tokyo Chemical Industry Co., Ltd.) serving as a quaternizing agent was added at room temperature. After that, the mixture was heated to reflux for 6 hours. Next, the reaction solution was cooled to room temperature, and acetonitrile was removed by evaporation under reduced pressure. The resultant concentrate was washed with 30.0 g of diethyl ether, and the supernatant was removed by liquid separation. The operations of washing and liquid separation were repeated three times to provide a residue.

Further, the resultant residue was dissolved in 110.0 g of acetone. To this solution, 232.1 g of lithium bis(trifluoromethanesulfonyl)imide (trade name: EF-N115, manufactured by Mitsubishi Materials Electronic Chemicals Co., Ltd.) serving as an anion exchange reagent dissolved in 250.0 g of ion-exchanged water was added dropwise over 30 minutes, and the mixture was stirred at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-1 containing a bis(trifluoromethanesulfonyl) imide anion as its anion.

(IP-1)

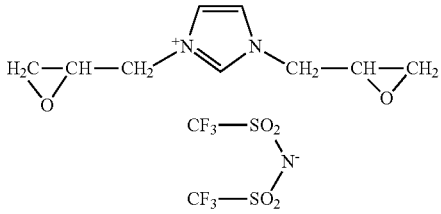

(Synthesis of Ionic Compounds IP-2, 3, 4, 5, 15, 16, 24, 25, and 27)

Ionic compounds IP-2, 3, 4, 5, 15, 16, 24, 25, and 27 were obtained in the same manner as in the synthesis of the ionic compound IP-1 except that the cation raw material, the tertiarizing agent, the quaternizing agent, the anion exchange reagent, and blending amounts thereof were changed as shown in Table 1.

mixture was heated to reflux for 3 hours. Next, the reaction solution was cooled to room temperature, the solution was subjected to liquid separation, and then the organic layer was washed three times with 60.0 g of ion-exchanged water. Subsequently, ethanol was removed by evaporation under reduced pressure to provide 1-bromo-3,4-epoxybutane (compound Z-1).

(Synthesis of Glycidylating Reagent (Compound Z-2))

59.3 g of 6-chloro-1-hexene (manufactured by Kanto Chemical Co., Inc.) was dissolved in 60.0 g of ethanol, and 94.9 g of 3-chloroperbenzoic acid (manufactured by Tokyo Chemical Industry Co., Ltd.) was added at 60° C. After that, the mixture was heated to reflux for 93 hours. Next, the reaction solution was cooled to room temperature, the solution was subjected to liquid separation, and then the organic layer was washed three times with 60.0 g of ion-exchanged water. Subsequently, ethanol was removed by evaporation under reduced pressure to provide 1-chloro-5,6-epoxyhexane (compound Z-2).

TABLE 1

| | Cation raw material | | Tertiarizing agent | | Quaternizing agent | | Anion exchange reagent | |
|---|---|---|---|---|---|---|---|---|
| No. | Product name | Weight (g) | Product name | Weight (g) | Product name | Weight (g) | Product name | Weight (g) |
| IP-1 | Imidazole (manufactured by Tokyo Chemical Industry Co., Ltd.) | 50.0 | Chloromethyloxirane (manufactured by Tokyo Chemical Industry Co., Ltd.) | 74.8 | Chloromethyloxirane (manufactured by Tokyo Chemical Industry Co., Ltd.) | 74.8 | Lithium N,N-bis(trifluoromethanesulfonyl)imide (trade name: EF-N115; manufactured by Mitsubishi Materials Electronic Chemicals Co., Ltd.) | 232.1 |
| IP-2 | | | | | | | Potassium N,N-bis(fluorosulfonyl)imide (trade name: K-FSI; manufactured by Mitsubishi Materials Electronic Chemicals Co., Ltd.) | 177.1 |
| IP-3 | | | | | | | Lithium bis(pentafluoroethanesulfonyl)imide (manufactured by Kishida Chemical Co., Ltd.) | 313.0 |
| IP-4 | | | | | | | Potassium N,N-hexafluoropropane-1,3-disulfonylimide (trade name: EF-N302; manufactured by Mitsubishi Materials Electronic Chemicals Co., Ltd.) | 267.7 |
| IP-5 | | | | | | | Lithium trifluoroacetate (manufactured by Wako Pure Chemical Industries, Ltd.) | 97.1 |
| IP-15 | Pyrazole (manufactured by Tokyo Chemical Industry Co., Ltd.) | | | 74.8 | | 74.8 | Lithium N,N-bis(trifluoromethanesulfonyl)imide (trade name: EF-N115; manufactured by Mitsubishi Materials Electronic Chemicals Co., Ltd.) | 232.1 |
| IP-16 | | | | | | | Sodium dicyanamide (manufactured by Tokyo Chemical Industry Co., Ltd.) | 72 |
| IP-24 | Dimethylamine (manufactured by Tokyo Chemical Industry Co., Ltd.) | 50.0 | Chloromethyloxirane (manufactured by Tokyo Chemical Industry Co., Ltd.) | 113.1 | Chloromethyloxirane (manufactured by Tokyo Chemical Industry Co., Ltd.) | 113.1 | Lithium N,N-bis(trifluoromethanesulfonyl)imide (trade name: EF-N115; manufactured by Mitsubishi Materials Electronic Chemicals Co., Ltd.) | 350.8 |
| IP-25 | Imidazole (manufactured by Tokyo Chemical Industry Co., Ltd.) | | | 74.8 | | 74.8 | — (No anion exchange) | — |
| IP-27 | | | | 74.8 | | 74.8 | Lithium perchlorate (manufactured by Tokyo Chemical Industry Co., Ltd.) | 86.1 |

(Synthesis of Glycidylating Reagent (Compound Z-1))

67.5 g of 4-bromo-1-butene (manufactured by Kanto Chemical Co., Inc.) was dissolved in 60.0 g of ethanol, and 94.9 g of 3-chloroperbenzoic acid (manufactured by Tokyo Chemical Industry Co., Ltd.) was added. After that, the (Synthesis of Ionic Compound IP-6)

50.0 g of 1-methylimidazole (manufactured by Kanto Chemical Co., Inc.) serving as a cation raw material was dissolved in 50.0 g of dichloromethane. To this solution, a mixed solution formed of 71.4 g of 1-bromo-3,4-epoxybutane (compound Z-1) serving as a glycidylating reagent dissolved in 50.0 g of dichloromethane and 4.01 g of aluminum chloride serving as a catalyst was added, and then the mixture was heated to reflux for 5 hours.

Next, the reaction solution was cooled to 10° C., 50.0 g of 4 mol/l hydrochloric acid was added, and the mixture was stirred for 30 minutes. After that, the dichloromethane layer was subjected to liquid separation, and a washing operation was performed twice with 120 g of ion-exchanged water. Next, dichloromethane was removed by evaporation under reduced pressure to provide a residue.

Subsequently, the resultant residue was dissolved in 70.0 g of acetonitrile, and 71.4 g of 1-bromo-3,4-epoxybutane (compound Z-1) serving as a quaternizing agent was added at room temperature. After that, the mixture was heated to reflux for 6 hours. Next, the reaction solution was cooled to room temperature, and acetonitrile was removed by evaporation under reduced pressure. The resultant concentrate was washed with 30.0 g of diethyl ether, and the supernatant was removed by liquid separation. The operations of washing and liquid separation were repeated three times to provide a residue.

Further, the resultant residue was dissolved in 110.0 g of acetone, and then 158.3 g of sodium heptafluorobutyrate (manufactured by Wako Pure Chemical Industries, Ltd.) serving as an anion exchange reagent dissolved in 180.0 g of ion-exchanged water was added dropwise over 30 minutes, followed by stirring at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-6 containing a heptafluorobutyrate anion as its anion.

(IP-6)

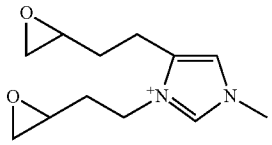

$CF_3CF_2CF_2COO^-$ (Synthesis of Ionic Compounds IP-7, 8, 9, 13, 14, 17, 19, and 21)

Ionic compounds IP-7, 8, 9, 13, 14, 17, 19, and 21 were obtained in the same manner as in the synthesis of the ionic compound IP-6 except that the cation raw material, the glycidylating reagent, the quaternizing agent, the anion exchange reagent, and blending amounts thereof were changed as shown in Table 2.

TABLE 2

| | Cation raw material | | Glycidylating reagent | | Quaternizing agent | | Anion exchange reagent | |
|---|---|---|---|---|---|---|---|---|
| No. | Product name | Weight (g) | Product name | Weight (g) | Product name | Weight (g) | Product name | Weight (g) |
| IP-6 | 1-Methylimidazole (manufactured by Kanto Chemical Co., Inc.) | 50.0 | Compound Z-1 | 126.1 | Compound Z-1 | 126.1 | Sodium heptafluorobutyrate (manufactured by Wako Pure Chemical Industries, Ltd.) | 158.3 |
| IP-7 | | | | | | | Potassium tris(trifluoromethanesulfonyl) methide (trade name: K-TFSM; manufactured by Central Glass Co., Ltd.) | 301.8 |
| IP-8 | | | | | | | Lithium trifluoromethane-sulfonate (trade name: EF-15; manufactured by Mitsubishi Materials Electronic Chemicals Co., Ltd.) | 104.6 |
| IP-9 | | | | | | | Potassium nonafluorobutane-sulfonate (trade name: KFBS; manufactured by Mitsubishi Materials Electronic Chemicals Co., Ltd.) | 226.7 |
| IP-13 | 1-Methylpyrrole (manufactured by Tokyo Chemical Industry Co., Ltd.) | 50.0 | Chloromethyloxirane (manufactured by Tokyo Chemical Industry Co., Ltd.) | 62.8 | Chloromethyloxirane (manufactured by Tokyo Chemical Industry Co., Ltd.) | 62.8 | Potassium hexafluoroarsenate (manufactured by Tokyo Chemical Industry Co., Ltd.) | 154.8 |
| IP-14 | Pyridine (manufactured by Wako Pure Chemical Industries, Ltd.) | | Compound Z-1 | 261.8 | 1-Bromobutane (manufactured by Kishida Chemical Co., Ltd.) | 95.4 | Lithium hexafluoroantimonate (manufactured by Wako Pure Chemical Industries, Ltd.) | 169.2 |

TABLE 2-continued

| No. | Cation raw material: Product name | Weight (g) | Glycidylating reagent: Product name | Weight (g) | Quaternizing agent: Product name | Weight (g) | Anion exchange reagent: Product name | Weight (g) |
|---|---|---|---|---|---|---|---|---|
| IP-17 | 1-Methylpyrazole (manufactured by Tokyo Chemical Industry Co., Ltd.) | | Chloromethyloxirane (manufactured by Tokyo Chemical Industry Co., Ltd.) | 62 | Chloromethyloxirane (manufactured by Tokyo Chemical Industry Co., Ltd.) | 62.0 | Lithium bis(oxalato)borate (trade name: LiBOB; manufactured by BOC Sciences) | 130.1 |
| IP-19 | Pyrimidine (manufactured by Wako Pure Chemical Industries, Ltd.) | | Compound Z-2 | 162.9 | Compound Z-2 | 81.5 | Lithium trifluoromethane-sulfonate (trade name: EF-15; manufactured by Mitsubishi Materials Electronic Chemicals Co., Ltd.) | 107.3 |
| IP-21 | Pyridine (manufactured by Wako Pure Chemical Industries, Ltd.) | | | 165.0 | | 82.5 | Lithium tetrafluoroborate (manufactured by Tokyo Chemical Industry Co., Ltd.) | 65.4 |

(Synthesis of Ionic Compound IP-18)

50.0 g of imidazole (manufactured by Tokyo Chemical Industry Co., Ltd.) serving as a cation raw material was dissolved in 50.0 g of dichloromethane. To this solution, a mixed solution formed of 74.8 g of chloromethyloxirane (manufactured by Tokyo Chemical Industry Co., Ltd.) serving as a glycidylating reagent dissolved in 50.0 g of dichloromethane and 3.8 g of aluminum chloride serving as a catalyst was added, and then the mixture was heated to reflux for 6 hours.

Next, the reaction solution was cooled to 10° C., 50.0 g of 4 mol/l hydrochloric acid was added, and the mixture was stirred for 30 minutes. After that, the dichloromethane layer was subjected to liquid separation, and a washing operation was performed twice with 120 g of ion-exchanged water.

To the resultant solution, a solution of 74.8 g of chloromethyloxirane (manufactured by Tokyo Chemical Industry Co., Ltd.) serving as a tertiarizing agent dissolved in 50.0 g of dichloromethane was added dropwise over 30 minutes, and the mixture was heated to reflux for 4 hours. Next, the reaction solution was cooled to room temperature, and 200 ml of a 5 mass % aqueous solution of sodium carbonate was added, followed by stirring for 30 minutes. After that, liquid separation was performed, and the dichloromethane layer was washed twice with 120 g of ion-exchanged water. Next, dichloromethane was removed by evaporation under reduced pressure to provide a residue.

Subsequently, the resultant residue was dissolved in 70.0 g of acetonitrile, and 74.8 g of chloromethyloxirane (manufactured by Tokyo Chemical Industry Co., Ltd.) serving as a quaternizing agent was added at room temperature. After that, the mixture was heated to reflux for 6 hours. Next, the reaction solution was cooled to room temperature, and acetonitrile was removed by evaporation under reduced pressure. The resultant concentrate was washed with 30.0 g of diethyl ether, and the supernatant was removed by liquid separation. The operations of washing and liquid separation were repeated three times to provide a residue.

Further, the resultant residue was dissolved in 110.0 g of acetone. To this solution, 232.1 g of lithium bis(trifluoromethanesulfonyl)imide (trade name: EF-N115, manufactured by Mitsubishi Materials Electronic Chemicals Co., Ltd.) serving as an anion exchange reagent dissolved in 250.0 g of ion-exchanged water was added dropwise over 30 minutes, and the mixture was stirred at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-18 containing a bis(trifluoromethanesulfonyl) imide anion as its anion.

(IP-18)

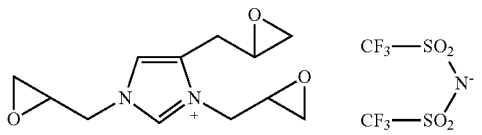

(Synthesis of Ionic Compound IP-22)

An ionic compound IP-22 was obtained in the same manner as in the synthesis of the ionic compound IP-18 except that the cation raw material, the glycidylating reagent, the tertiarizing agent, the quaternizing agent, the anion exchange reagent, and blending amounts thereof were changed as shown in Table 3.

TABLE 3

| | Cation raw material | | Glycidylating reagent | | Tertiarizing agent | | Quaternizing agent | | Anion exchange reagent | |
|---|---|---|---|---|---|---|---|---|---|---|
| No. | Product name | Weight (g) | Product name | Weight (g) | Product name | Weight (g) | Product name | Weight (g) | Product name | Weight (g) |
| IP-18 | Imidazole (manufactured by Tokyo Chemical Industry Co., Ltd.) | 50.0 | Chloromethyl-oxirane (manufactured by Tokyo Chemical Industry Co., Ltd.) | 74.8 | Chloromethyl-oxirane (manufactured by Tokyo Chemical Industry Co., Ltd.) | 74.8 | Chloromethyl-oxirane (manufactured by Tokyo Chemical Industry Co., Ltd.) | 74.8 | Lithium N,N-bis(trifluoromethane-sulfonyl)imide (trade name: EF-N115; manufactured by Mitsubishi Materials Electronic Chemicals Co., Ltd.) | 232.1 |
| IP-22 | Pyridazine (manufactured by Tokyo Chemical Industry Co., Ltd.) | | | 63.6 | | 63.6 | | 63.6 | | 197.3 |

(Synthesis of Ionic Compound IP-10)

50.0 g of pyrrolidine (manufactured by Tokyo Chemical Industry Co., Ltd.) serving as a cation raw material was dissolved in 30.0 g of dichloromethane and 30.0 g of acetonitrile. To this solution, a solution of 143.7 g of chloromethyloxirane (manufactured by Tokyo Chemical Industry Co., Ltd.) serving as a tertiarizing/quaternizing agent dissolved in 80.0 g of dichloromethane was added dropwise at room temperature for 30 minutes, and the mixture was heated to reflux for 6 hours. Next, the reaction solution was cooled to room temperature, and 200 ml of a 5 mass % aqueous solution of sodium carbonate was added, followed by stirring for 30 minutes. After that, liquid separation was performed, and the dichloromethane/acetonitrile layer was washed twice with 120 g of ion-exchanged water. Next, dichloromethane and acetonitrile were removed by evaporation under reduced pressure to provide a residue.

Further, the resultant residue was dissolved in 110.0 g of acetone. To this solution, 222.3 g of lithium bis(trifluoromethanesulfonyl)imide (trade name: EF-N115, manufactured by Mitsubishi Materials Electronic Chemicals Co., Ltd.) serving as an anion exchange reagent dissolved in 250.0 g of ion-exchanged water was added dropwise over 30 minutes, and the mixture was stirred at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-10 containing a bis(trifluoromethanesulfonyl) imide anion as its anion.

(IP-10)

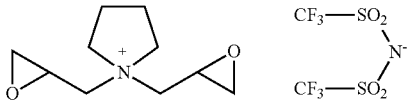

(Synthesis of Ionic Compounds IP-11, 12, and 26)

Ionic compounds IP-11, 12, and 26 were obtained in the same manner as in the synthesis of the ionic compound IP-10 except that the cation raw material, the tertiarizing/quaternizing agent, the anion exchange reagent, and blending amounts thereof were changed as shown in Table 4.

TABLE 4

| | Cation raw material | | Tertiarizing/quaternizing agent | | Anion exchange reagent | |
|---|---|---|---|---|---|---|
| No. | Product name | Weight (g) | Product name | Weight (g) | Product name | Weight (g) |
| IP-10 | Pyrrolidine (manufactured by Tokyo Chemical Industry Co., Ltd.) | 50.0 | Chloromethyloxirane (manufactured by Tokyo Chemical Industry Co., Ltd.) | 143.7 | Lithium N,N-bis(trifluoromethanesulfonyl)imide (trade name: EF-N115; manufactured by Mitsubishi Materials Electronic Chemicals Co., Ltd.) | 222.3 |
| IP-11 | | | | | Lithium tetrafluoroborate (manufactured by Tokyo Chemical Industry Co., Ltd.) | 72.8 |
| IP-12 | | | | | Lithium hexafluorophosphate (manufactured by Wako Pure Chemical Industries, Ltd.) | 117.7 |
| IP-26 | | | | 143.7 | Lithium nitrate (manufactured by Kishida Chemical Co., Ltd.) | 53.5 |

(Synthesis of Ionic Compound IP-20)

50.0 g of pyrrole (manufactured by Tokyo Chemical Industry Co., Ltd.) serving as a cation raw material was dissolved in 50.0 g of dichloromethane. To this solution, a mixed solution formed of 75.9 g of chloromethyloxirane (manufactured by Tokyo Chemical Industry Co., Ltd.) serving as a glycidylating reagent dissolved in 50.0 g of dichloromethane and 4.2 g of aluminum chloride serving as a catalyst was added, and then the mixture was heated to reflux for 6 hours.

Next, the reaction solution was cooled to 10° C., 50.0 g of 4 mol/l hydrochloric acid was added, and the mixture was stirred for 30 minutes. After that, the dichloromethane layer was subjected to liquid separation, and a washing operation was performed twice with 120 g of ion-exchanged water.

To the resultant solution, a solution of 75.9 g of chloromethyloxirane (manufactured by Tokyo Chemical Industry Co., Ltd.) serving as a tertiarizing agent dissolved in 50.0 g of dichloromethane was added dropwise over 30 minutes, and the mixture was heated to reflux for 4 hours. Next, the reaction solution was cooled to room temperature, and 200 ml of a 5 mass % aqueous solution of sodium carbonate was added, followed by stirring for 30 minutes. After that, liquid separation was performed, and the dichloromethane layer was washed twice with 120 g of ion-exchanged water. Next, dichloromethane was removed by evaporation under reduced pressure to provide a residue.

Subsequently, the resultant residue was dissolved in 70.0 g of acetonitrile, and 75.9 g of chloromethyloxirane (manufactured by Tokyo Chemical Industry Co., Ltd.) serving as a quaternizing agent was added at room temperature. After that, the mixture was heated to reflux for 10 hours. Next, the reaction solution was cooled to room temperature, and acetonitrile was removed by evaporation under reduced pressure. The resultant concentrate was washed with 30.0 g of diethyl ether, and the supernatant was removed by liquid separation. The operations of washing and liquid separation were repeated three times to provide a residue.

Further, the resultant residue was dissolved in 110.0 g of acetone. To this solution, 235.6 g of lithium bis(trifluoromethanesulfonyl)imide (trade name: EF-N115, manufactured by Mitsubishi Materials Electronic Chemicals Co., Ltd.) serving as an anion exchange reagent dissolved in 250.0 g of ion-exchanged water was added dropwise over 30 minutes, and the mixture was stirred at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-20 containing a bis(trifluoromethanesulfonyl) imide anion as its anion.

(IP-20)

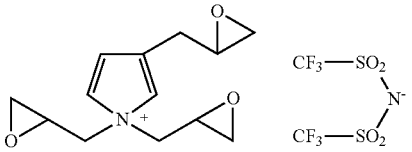

(Synthesis of Ionic Compound IP-23)

To 127.2 g of chloromethyloxirane (manufactured by Tokyo Chemical Industry Co., Ltd.) dissolved in 120.0 g of tetrahydrofuran, 3.8 g of metal lithium was added, and the mixture was heated to reflux for 1 hour. Next, 50.0 g of pyridazine (manufactured by Tokyo Chemical Industry Co., Ltd.) serving as a cation raw material was added dropwise at room temperature over 30 minutes, and the mixture was heated to reflux for 6 hours.

Next, the reaction solution was cooled to 10° C., 50.0 g of 4 mol/l hydrochloric acid was added, and the mixture was stirred for 30 minutes. After that, 120.0 g of dichloromethane was added, the organic layer was subjected to liquid separation, and a washing operation was performed twice with 120 g of ion-exchanged water. Next, dichloromethane was removed by evaporation under reduced pressure to provide a residue.

Subsequently, the resultant residue was dissolved in 70.0 g of acetonitrile, and 63.6 g of chloromethyloxirane (manufactured by Tokyo Chemical Industry Co., Ltd.) serving as a quaternizing agent was added at room temperature. After that, the mixture was heated to reflux for 10 hours. Next, the reaction solution was cooled to room temperature, and acetonitrile was removed by evaporation under reduced pressure. The resultant concentrate was washed with 30.0 g of diethyl ether, and the supernatant was removed by liquid separation. The operations of washing and liquid separation were repeated three times to provide a residue.

Further, the resultant residue was dissolved in 80.0 g of acetone. To this solution, 61.2 g of sodium dicyanamide (manufactured by Tokyo Chemical Industry Co., Ltd.) serving as an anion exchange reagent dissolved in 65.0 g of ion-exchanged water was added dropwise over 30 minutes, and the mixture was stirred at 30° C. for 12 hours. The resultant solution was subjected to liquid separation, and the organic layer was washed three times with 80.0 g of ion-exchanged water. Subsequently, acetone was removed by evaporation under reduced pressure to provide an ionic compound IP-23 containing a dicyanamide anion as its anion.

(IP-23)

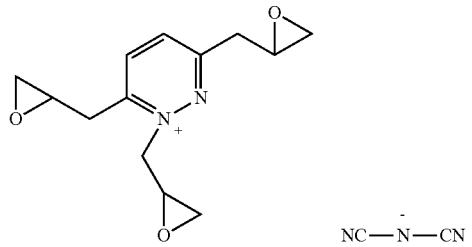

The cation, the number of glycidyl groups, and the anion of each of the obtained ionic compounds IP-1 to 27 are shown in Table 5.

TABLE 5

| No. | Cation | Number of glycidyl groups | Anion |
|---|---|---|---|
| IP-1 | Formula (14) | 2 | $(CF_3SO_2)_2N$— |
| IP-2 | | | $(FSO_2)_2N$— |
| IP-3 | | | $(CF_3CF_2SO_2)_2N$— |
| IP-4 | | | $(SO_2C_3F_6SO_2)N$— |
| IP-5 | | | $CF_3COO$— |
| IP-6 | Formula (15) | | $CF_3CF_2CF_2COO$— |
| IP-7 | | | $(CF_3SO_2)_3C$— |
| IP-8 | | | $CF_3SO_3$— |
| IP-9 | | | $CF_3CF_2CF_2CF_2SO_3$— |
| IP-10 | Formula (18) | | $(CF_3SO_2)_2N$— |
| IP-11 | | | $BF_4$— |
| IP-12 | | | $PF_6$— |
| IP-13 | Formula (28) | | $AsF_6$— |
| IP-14 | Formula (20) | | $SbF_6$— |
| IP-15 | Formula (23) | | $(CF_3SO_2)_2N$— |
| IP-16 | | | $(CN_2)N$— |
| IP-17 | Formula (24) | | $(C_2O_4)_2B$— |
| IP-18 | Formula (16) | 3 | $(CF_3SO_2)_2N$— |
| IP-19 | Formula (15) | | $CF_3SO_3$— |
| IP-20 | Formula (21) | | $(CF_3SO_2)_2N$— |
| IP-21 | Formula (19) | | $BF_4$— |
| IP-22 | Formula (25) | | $(CF_3SO_2)_2N$— |
| IP-23 | Formula (26) | | $(CN_2)N$— |

TABLE 5-continued

| No. | Cation | Number of glycidyl groups | Anion |
|---|---|---|---|
| IP-24 | — | 2 | $(CF_3SO_2)_2N$— |
| IP-25 | Formula (14) | | Cl— |
| IP-26 | Formula (18) | | $NO_3$— |
| IP-27 | Formula (14) | | $ClO_4$— |

Example 1

Preparation of Electroconductive Substrate 2

Prepared as the electroconductive substrate 2 was a product obtained by applying and baking a primer (trade name: DY35-051; manufactured by Dow Corning Toray Co., Ltd.) to a cored bar made of SUS304 having a diameter of 6 mm.

(Production of Elastic Roller)

<Production of Silicone Rubber Elastic Roller>

The electroconductive substrate 2 prepared in the foregoing was placed in a mold, and an addition-type silicone rubber composition obtained by mixing the following materials was injected into a cavity formed in the mold.

Liquid silicone rubber material (trade name: SE6724A/B; manufactured by Dow Corning Toray Co., Ltd.) 100.0 parts by mass Carbon black (trade name: TOKABLACK #4300; manufactured by Tokai Carbon Co., Ltd.) 15.0 parts by mass Platinum catalyst 0.1 part by mass Subsequently, the mold was heated, and the silicone rubber composition was vulcanized and cured at a temperature of 150° C. for 15 minutes. The electroconductive substrate having a cured silicone rubber layer formed on its peripheral surface was removed from the mold, and then the curing reaction of the silicone rubber layer was completed by further heating the cored bar at a temperature of 180° C. for 1 hour. Thus, an elastic roller D-1 in which a silicone rubber elastic layer having a diameter of 12 mm had been formed on the outer periphery of the electroconductive substrate 2 was produced.

<Production of NBR Rubber Elastic Roller>

Respective materials whose kinds and amounts were shown below were mixed with a pressure-type kneader to provide an A-kneaded rubber composition.

NBR rubber (trade name: Nipol DN219; manufactured by Zeon Corporation) 100.0 parts by mass Carbon black (trade name: TOKABLACK #4300; manufactured by Tokai Carbon Co., Ltd.) 40.0 parts by mass Calcium carbonate (trade name: Nanox #30; manufactured by Maruo Calcium Co., Ltd.) 20.0 parts by mass Stearic acid (trade name: Stearic acid S; manufactured by Kao Corporation) 1.0 part by mass Further, 166.0 parts by mass of the A-kneaded rubber composition, and respective materials whose kinds and amounts were shown below were mixed with an open roll to prepare an unvulcanized rubber composition.

Sulfur (trade name: Sulfax 200S; manufactured by Tsurumi Chemical Industry Co., Ltd.) 1.2 parts by mass Tetrabenzylthiuram disulfide (trade name: TBZTD; manufactured by Sanshin Chemical Industry Co., Ltd.) 4.5 parts by mass Next, a crosshead extruder having a mechanism for supplying an electroconductive substrate and a mechanism for discharging an unvulcanized rubber roller was prepared. A die having an inner diameter of 16.5 mm was attached to a crosshead, and the temperature of the extruder and the crosshead, and the speed at which the electroconductive substrate was conveyed were adjusted to 80° C. and 60 mm/second, respectively. Under the foregoing conditions, the unvulcanized rubber composition was supplied from the extruder, and in the crosshead, the electroconductive substrate was covered with the unvulcanized rubber composition as an elastic layer. Thus, an unvulcanized rubber roller was obtained. Next, the unvulcanized rubber roller was loaded into a hot-air vulcanizing furnace at 170° C. and heated for 60 minutes to provide an unpolished elastic roller. After that, the end portions of the elastic layer were cut and removed, and the surface of the elastic layer was polished with a rotary grindstone. Thus, an elastic roller D-2 in which each of diameters at positions distant from its central portion toward both end portions by 90 mm was 8.4 mm and a diameter at the central portion was 8.5 mm was produced.

(Formation of Surface Layer 4)

Under a nitrogen atmosphere, 100.0 parts by mass of polyether polyol (trade name: PTG-L1000; manufactured by Hodogaya Chemical Co., Ltd.) was gradually added dropwise to 84.1 parts by mass of polymeric MDI (trade name: MILLIONATE MR-200; manufactured by Nippon Polyurethane Industry Co., Ltd.) in a reaction vessel while a temperature in the reaction vessel was held at 65° C. After the completion of the dropwise addition, the mixture was subjected to a reaction at a temperature of 65° C. for 2.5 hours, and 80.0 parts by mass of methyl ethyl ketone was added to the resultant. The resultant reaction mixture was cooled to room temperature to provide an isocyanate group-terminated prepolymer B-1 having an isocyanate group content of 5.4 mass %.

As materials for the surface layer 4, 71.9 parts by mass of polyether polyol (trade name: PTG-L1000; manufactured by Hodogaya Chemical Co., Ltd.), 28.1 parts by mass of the isocyanate group-terminated prepolymer B-1, 1.0 part by mass of the ionic compound IP-1, 15.0 parts by mass of silica (trade name: AEROSIL 200; manufactured by Nippon Aerosil Co., Ltd.), and 15.0 parts by mass of urethane resin fine particles (trade name: Art Pearl C-400; manufactured by Negami Chemical Industrial Co., Ltd.) were stirred and mixed.

Next, methyl ethyl ketone was added to the mixture so that a total solid content ratio became 30 mass %. After that, the contents were mixed with a sand mill. Further, the viscosity of the mixture was adjusted to from 10 cps to 12 cps with methyl ethyl ketone. Thus, a paint for forming a surface layer was prepared.

A coating film of the paint for forming a surface layer was formed on the surface of the elastic layer of the elastic roller D-1 produced in advance by immersing the elastic roller D-1 in the paint, and was dried. Further, the surface layer 4 having a thickness of 15 μm was formed on the outer periphery of the elastic layer by subjecting the resultant to heat treatment at a temperature of 150° C. for 1 hour. Thus, an electrophotographic member was produced.

The resin in the surface layer 4 of the electrophotographic member was analyzed by using a pyrolyzer (trade name: PYROFOIL SAMPLER JPS-700, manufactured by Japan Analytical Industry Co., Ltd.) and a GC/MS apparatus (trade name: Focus GC/ISQ, manufactured by Thermo Fischer Scientific K.K.), and helium as a carrier gas at a pyrolysis temperature of 590° C. As a result, it was confirmed from the resultant fragment peak that the resin had the structure represented by the formula (1).

The electrophotographic member thus obtained was evaluated for the following items.

<Resistance Value Evaluation>

The measurement of a resistance value of the electrophotographic member which was left to stand under a 23° C. and 45% RH (hereinafter described as "N/N") environment was performed under the N/N environment. In addition, the measurement of a resistance value of the electrophotographic member which was left to stand under a 0° C. environment was also performed under the 0° C. environment.

Figure 4A:
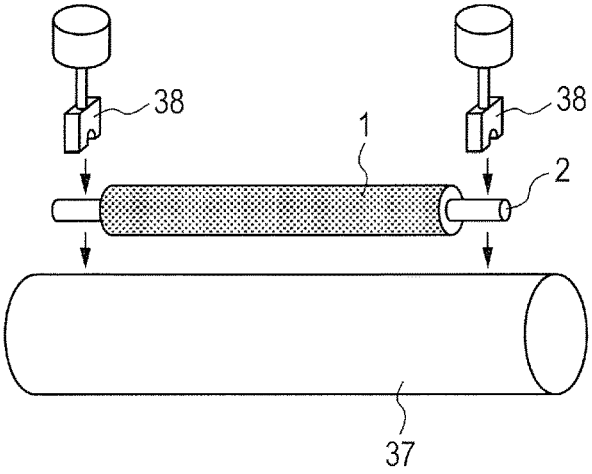
FIG. 4A and FIG. 4B are schematic construction views of a jig for evaluating a fluctuation in resistance value according to the present invention.
Figure 4B:
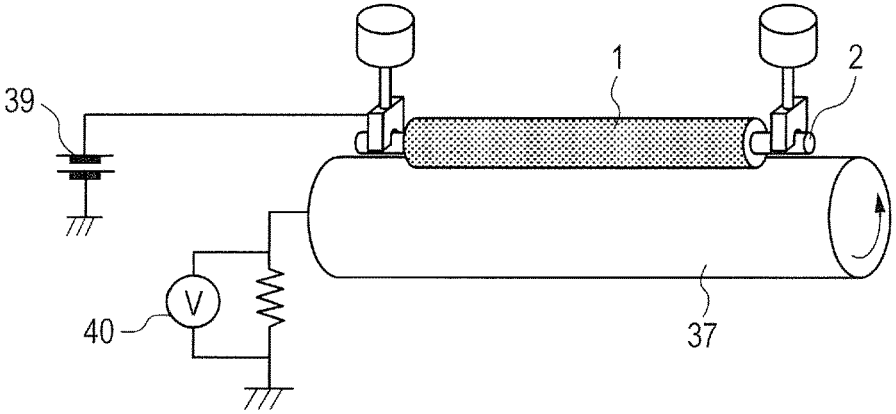

FIG. 4A and FIG. 4B are schematic construction views of a jig for evaluating a fluctuation in resistance value. In FIG. 4A, while both ends of the electroconductive substrate 2 were each pressed with a load of 4.9 N through the intermediation of an electroconductive bearing 38, a columnar metal 37 having a diameter of 40 mm was rotated to rotationally drive the electrophotographic member 1 at a speed of 60 rpm. Next, in FIG. 4B, a voltage of 50 V was applied from a high-voltage power source 39, and a potential difference between both ends of a resistor having a known electrical resistance (having an electrical resistance lower than the electrical resistance of the electrophotographic member 1 by two orders of magnitude or more) placed between the columnar metal 37 and the ground was measured. The potential difference was measured using a voltmeter 40 (189TRUE RMS MULTIMETER manufactured by Fluke Corporation). A current which had flowed through the electrophotographic member 1 into the columnar metal 37 was determined by calculation based on the measured potential difference and the electrical resistance of the resistor. The applied voltage of 50 V was divided by the resultant current to determine the resistance value of the electrophotographic member 1. In the measurement of the potential difference, 2 seconds after the application of the voltage, sampling was performed for 3 seconds and a value calculated from the average value of the sampled data was defined as an initial resistance value.

<Evaluation as Developing Member>

(Evaluation of 0° C. Ghost)

Next, the electrophotographic member subjected to the measurement of its resistance in the 0° C. environment as described above was subjected to the following evaluation. The electrophotographic member of this example was mounted as a developing member onto a laser printer (trade name: LBP7700C; manufactured by Canon Inc.), and the laser printer was placed and left to stand for 2 hours under a 0° C. environment. Then, evaluation of a ghost image was performed.

Specifically, as an image pattern, a 15-mm square solid black image was printed at a tip portion in one sheet by using a black toner, and then an entire halftone image was printed on the sheet by using the toner. Next, the non-uniform density of the period of a toner carrier appearing in a halftone portion was visually evaluated, and the evaluation for a ghost was performed by the following criteria.

A: No ghost is observed.

B: An extremely slight ghost is observed.

C: A remarkable ghost is observed.

The results obtained by the above-mentioned evaluation tests are shown in Table 7.

Examples 2 to 9, 18, and 19

Electrophotographic members were produced and evaluated in the same manner as in Example 1 except that the kinds and amounts of the ionic compound, the compound capable of reacting with a glycidyl group, and the curing agent were changed as shown in Table 6. The results are shown in Table 7.

TABLE 6

| | Ionic compound | | Compound capable of reacting with glycidyl group | | Curing agent | |
|---|---|---|---|---|---|---|
| | No. | Part(s) by mass | Product name | Part(s) by mass | Product name | Part(s) by mass |
| Example 1 | IP-1 | 1.0 | PTG-L 1000 | 45.6 | Isocyanate group-terminated prepolymer B-1 | 77.9 |
| Example 2 | IP-2 | | | | | |
| Example 3 | IP-3 | | | | | |
| Example 4 | IP-4 | | | | | |
| Example 5 | IP-5 | | | | | |
| Example 6 | IP-6 | | | | | |
| Example 7 | IP-7 | | | | | |
| Example 8 | IP-8 | | | | | |
| Example 9 | IP-9 | | | | | |
| Example 10 | IP-10 | 3.0 | EPOMIN SP-012 | 17.1 | CORONATE 4078 | 83.0 |
| Example 11 | IP-11 | | | | | |
| Example 12 | IP-12 | | | | | |
| Example 13 | IP-13 | | | | | |
| Example 14 | IP-14 | | | | | |
| Example 15 | IP-15 | 5.0 | DAIFERAMINE MAU-5022 | 119.7 | | 58.1 |
| Example 16 | IP-16 | | | | | |
| Example 17 | IP-17 | | | | | |
| Example 18 | IP-18 | 1.0 | PTG-L 1000 | 45.6 | Isocyanate group-terminated prepolymer B-1 | 77.9 |
| Example 19 | IP-19 | | | | | |
| Example 20 | IP-20 | 3.0 | EPOMIN SP-012 | 17.1 | CORONATE 4078 | 83.0 |
| Example 21 | IP-21 | | | | | |
| Example 22 | IP-22 | 5.0 | DAIFERAMINE MAU-5022 | 119.7 | | 58.1 |
| Example 23 | IP-23 | | | | | |
| Comparative Example 1 | IP-24 | 1.0 | PTG-L 1000 | 45.6 | Isocyanate group- | 77.9 |

TABLE 6-continued

| | Ionic compound | | Compound capable of reacting with glycidyl group | | Curing agent | |
|---|---|---|---|---|---|---|
| | No. | Part(s) by mass | Product name | Part(s) by mass | Product name | Part(s) by mass |
| Comparative Example 2 | IP-25 | 1.0 | | | terminated prepolymer B-1 | |
| Comparative Example 3 | IP-26 | 3.0 | EPOMIN SP-012 | 17.1 | CORONATE 4078 | 83.0 |
| Comparative Example 4 | IP-27 | 5.0 | DAIFERAMINE MAU-5022 | 119.7 | | 58.1 |

EPOMIN SP-012: trade name, manufactured by Nippon Shokubai Co., Ltd., polyethyleneimine DAIFERAMINE MAU-5022: trade name, manufactured by Dainichiseika Color & Chemicals Mfg. Co., Ltd., carboxyl group-containing urethane resin CORONATE 4078: trade name, manufactured by Nippon Polyurethane Industry Co., Ltd., polyisocyanate

Example 10

12.8 Parts by mass of polyethyleneimine (trade name: EPOMIN SP-012; manufactured by Nippon Shokubai Co., Ltd.), 124.5 parts by mass of polyisocyanate (trade name: CORONATE 4078; manufactured by Nippon Polyurethane Industry Co., Ltd.), 3.0 parts by mass of the ionic compound IP-10, 15.0 parts by mass of silica (trade name: AEROSIL 200; manufactured by Nippon Aerosil Co., Ltd.), and 15.0 parts by mass of urethane resin fine particles (trade name: Art Pearl C-400; manufactured by Negami Chemical Industrial Co., Ltd.) were stirred and mixed. Thereafter, an electrophotographic member was produced and evaluated in the same manner as in Example 1. The results are shown in Table 7.

Examples 11 to 14, 20, and 21

Electrophotographic members were produced and evaluated in the same manner as in Example 10 except that the ionic compound was changed as shown in Table 6. The results are shown in Table 7.

Example 15

64.7 Parts by mass of a carboxyl group-containing urethane resin (trade name: DAIFERAMINE MAU-5022; manufactured by Dainichiseika Color & Chemicals Mfg. Co., Ltd.), 50.5 parts by mass of polyisocyanate (trade name: CORONATE 4078; manufactured by Nippon Polyurethane Industry Co., Ltd.), 5.0 parts by mass of the ionic compound IP-15, 15.0 parts by mass of silica (trade name: AEROSIL 200; manufactured by Nippon Aerosil Co., Ltd.), and 15.0 parts by mass of urethane resin fine particles (trade name: Art Pearl C-400; manufactured by Negami Chemical Industrial Co., Ltd.) were stirred and mixed. Thereafter, an electrophotographic member was produced and evaluated in the same manner as in Example 1. The results are shown in Table 7.

Examples 16, 17, 22, and 23

Electrophotographic members were produced and evaluated in the same manner as in Example 15 except that the ionic compound was changed as shown in Table 6. The results are shown in Table 7.

Comparative Examples 1 and 2

Electrophotographic members were produced and evaluated in the same manner as in Example 1 except that the ionic compound was changed as shown in Table 6. The results are shown in Table 7.

Comparative Example 3

An electrophotographic member was produced and evaluated in the same manner as in Example 10 except that the ionic compound was changed as shown in Table 6. The results are shown in Table 7.

Comparative Example 4

An electrophotographic member was produced and evaluated in the same manner as in Example 15 except that the ionic compound was changed as shown in Table 6. The results are shown in Table 7.

TABLE 7

| | Ionic compound | Number of crosslinking points between ionic compound and resin | Binder | N/N resistance (Ω) | 0° C. resistance (Ω) | (0° C. resistance)/(N/N resistance) | 0° C. ghost |
|---|---|---|---|---|---|---|---|
| Example 1 | IP-1 | 2 | PTG-L1000/Isocyanate | $3.17 \times 10^6$ | $8.16 \times 10^7$ | 25.7 | A |
| Example 2 | IP-2 | | group-terminated | $4.13 \times 10^6$ | $1.84 \times 10^8$ | 44.6 | A |
| Example 3 | IP-3 | | prepolymer B-1 | $5.56 \times 10^6$ | $1.85 \times 10^8$ | 33.3 | A |
| Example 4 | IP-4 | | | $6.90 \times 10^6$ | $2.50 \times 10^8$ | 36.2 | A |
| Example 5 | IP-5 | | | $6.64 \times 10^6$ | $4.16 \times 10^8$ | 62.6 | B |
| Example 6 | IP-6 | | | $5.98 \times 10^6$ | $1.93 \times 10^8$ | 32.2 | A |
| Example 7 | IP-7 | | | $7.01 \times 10^6$ | $3.03 \times 10^8$ | 43.2 | B |
| Example 8 | IP-8 | | | $3.90 \times 10^6$ | $1.43 \times 10^8$ | 36.5 | A |
| Example 9 | IP-9 | | | $8.05 \times 10^6$ | $2.23 \times 10^8$ | 27.6 | A |

TABLE 7-continued

| | Ionic compound | Number of crosslinking points between ionic compound and resin | Binder | N/N resistance (Ω) | 0° C. resistance (Ω) | (0° C. resistance)/(N/N resistance) | 0° C. ghost |
|---|---|---|---|---|---|---|---|
| Example 10 | IP-10 | | EPOMIN SP-012/CORONATE 4078 | $3.13 \times 10^6$ | $8.25 \times 10^7$ | 26.4 | A |
| Example 11 | IP-11 | | | $6.18 \times 10^6$ | $2.61 \times 10^8$ | 42.2 | A |
| Example 12 | IP-12 | | | $4.94 \times 10^6$ | $2.11 \times 10^8$ | 42.6 | A |
| Example 13 | IP-13 | | | $5.22 \times 10^6$ | $3.21 \times 10^8$ | 61.4 | B |
| Example 14 | IP-14 | | | $5.13 \times 10^6$ | $1.61 \times 10^8$ | 31.3 | A |
| Example 15 | IP-15 | | DAIFERAMINE MAU-5022/CORONATE 4078 | $3.13 \times 10^6$ | $7.70 \times 10^7$ | 24.6 | A |
| Example 16 | IP-16 | | | $6.66 \times 10^6$ | $1.61 \times 10^8$ | 24.1 | A |
| Example 17 | IP-17 | | | $4.11 \times 10^6$ | $1.80 \times 10^8$ | 43.8 | A |
| Example 18 | IP-18 | 3 | PTG-L1000/Isocyanate group-terminated prepolymer B-1 | $6.10 \times 10^5$ | $5.58 \times 10^6$ | 9.15 | A |
| Example 19 | IP-19 | | | $7.06 \times 10^5$ | $7.67 \times 10^6$ | 10.9 | A |
| Example 20 | IP-20 | | EPOMIN SP-012/CORONATE 4078 | $7.84 \times 10^5$ | $9.42 \times 10^6$ | 12.0 | A |
| Example 21 | IP-21 | | | $6.70 \times 10^5$ | $1.25 \times 10^7$ | 18.6 | A |
| Example 22 | IP-22 | | DAIFERAMINE MAU-5022/CORONATE 4078 | $7.60 \times 10^5$ | $1.11 \times 10^7$ | 14.6 | A |
| Example 23 | IP-23 | | | $8.20 \times 10^5$ | $1.61 \times 10^7$ | 19.6 | A |
| Comparative Example 1 | IP-24 | 2 | PTG-L1000/Isocyanate group-terminated prepolymer B-1 | $8.50 \times 10^6$ | $7.90 \times 10^8$ | 92.9 | C |
| Comparative Example 2 | IP-25 | | | $9.40 \times 10^8$ | $9.10 \times 10^{10}$ | 96.8 | C |
| Comparative Example 3 | IP-26 | | EPOMIN SP-012/CORONATE 4078 | $4.60 \times 10^8$ | $5.90 \times 10^{10}$ | 128.3 | C |
| Comparative Example 4 | IP-27 | | DAIFERAMINE MAU-5022/CORONATE 4078 | $4.80 \times 10^7$ | $6.66 \times 10^9$ | 138.8 | C |

In each of Examples 1 to 23, the surface layer contained the resin having, in the molecule, at least one cation structure selected from the group consisting of the formulae (1) to (13), and the anion according to the present invention. Accordingly, the increase in resistance under the environment having a low temperature near 0° C. was small and the image quality was satisfactory. On the other hand, in each of Comparative Example 1, in which the resin did not contain, in the molecule, at least one cation structure selected from the group consisting of the formulae (1) to (13), and Comparative Examples 2, 3, and 4, in which the surface layer did not contain the anion according to the present invention, an increase in resistance under the low-temperature environment was observed and the occurrence of a ghost image was observed.

Example 24

The previously produced elastic roller D-2 was immersed in the paint for forming a surface layer prepared in Example 1 to form a coating film of the paint on the surface of the elastic layer of the elastic roller D-2, followed by drying. Thereafter, an electrophotographic member was produced in the same manner as in Example 1.

Example 25

An electrophotographic member was produced in the same manner as in Example 24 except that the paint for forming a surface layer was changed to the one prepared in Example 18.

Comparative Example 5

An electrophotographic member was produced in the same manner as in Example 24 except that the paint for forming a surface layer was changed to the one prepared in Comparative Example 1.

(Resistance Value Evaluation)

The measurement of each resistance value of the electrophotographic members of the Examples and the Comparative Examples which were left to stand under a 23° C. and 45% RH (hereinafter described as "N/N") environment was performed under the N/N environment. In addition, the measurement of a resistance value of the electrophotographic members of the Examples and the Comparative Examples which were left to stand under a 0° C. environment was also performed under the 0° C. environment. FIG. 4A and FIG. 4B are schematic construction views of a jig for evaluating a fluctuation in resistance value. In FIG. 4A, while both ends of the electroconductive substrate were each pressed with a load of 4.9 N through the intermediation of the electroconductive bearing 38, the columnar metal 37 having a diameter of 30 mm was rotated at a speed of 30 rpm to rotationally drive the electrophotographic member 1. Next, in FIG. 4B, a voltage of 200 V was applied from the high-voltage power source 39, and a potential difference between both ends of a resistor having a known electrical resistance (having an electrical resistance lower than the electrical resistance of the electrophotographic member 1 by two orders of magnitude or more) placed between the columnar metal 37 and the ground was measured. The potential difference was measured using the voltmeter 40 (189TRUE RMS MULTIMETER manufactured by Fluke Corporation). A current which had flowed through the electrophotographic member 1 into the columnar metal 37 was determined by calculation based on the measured potential difference and the electrical resistance of the resistor. The applied voltage of 200 V was divided by the resultant current to determine the electrical resistance value of the electrophotographic member 1. In the measurement of the potential difference, 2 seconds after the application of the voltage, sampling was performed for 3 seconds and a value calculated from the average value of the sampled data was defined as an initial resistance value. Evaluation was performed by adopting the same environment for the resistance measurement and the same period of time for standing as those of Example 1. The results are shown in Table 8.

<Evaluation as Charging Member>

(Horizontal Streak Image Evaluation Under 0° C. Environment)

An increase in resistance of a charging member may cause fine streak-like density unevenness in a halftone image, which is called a horizontal streak image. The horizontal streak image tends to be caused as the resistance increases, and tends to become conspicuous along with long-term use. In view of this, the produced electrophotographic member was incorporated as a charging member and subjected to the following evaluation.

Each of the electrophotographic members obtained in Examples 24 and 25, and Comparative Example 5 was mounted as a charging member onto a laser printer of an electrophotographic system (trade name: HP ColoR LAseRjet ENteRpRise CP4515dN, manufactured by HP). After that, the laser printer was placed and left to stand for 2 hours under a 0° C. environment. Then, an endurance test in which an image having a print density of 4% (such an image that horizontal lines each having a width of 2 dots were drawn in a direction vertical to the rotation direction of a photosensitive member at an interval of 50 dots) was continuously output was performed. In addition, after the image had been output on 24,000 sheets, a halftone image (such an image that horizontal lines each having a width of 1 dot were drawn in the direction vertical to the rotation direction of the photosensitive member at an interval of 2 dots) was output for an image check. The resultant image was visually observed and a horizontal streak was evaluated by the following criteria. The results are shown in Table 8.

A: No horizontal streak occurs.

B: A horizontal streak slightly occurs only in an end portion of the image.

C: A horizontal streak occurs in a substantially half region of the image and is conspicuous.

TABLE 8

| | Ionic compound | Number of crosslinking points between ionic compound and resin | N/N resistance (Ω) | 0° C. resistance (Ω) | (0° C. resistance)/(N/N resistance) | 0° C. horizontal streak |
|---|---|---|---|---|---|---|
| Example 24 | IP-1 | 2 | $2.40 \times 10^7$ | $8.60 \times 10^8$ | 35.8 | A |
| Example 25 | IP-18 | 3 | $3.90 \times 10^6$ | $6.60 \times 10^7$ | 16.9 | A |
| Comparative Example 5 | IP-24 | 2 | $4.20 \times 10^7$ | $5.30 \times 10^9$ | 126.2 | C |

In each of Examples 24 and 25, the surface layer contained the resin having, in the molecule, the cation structure represented by the formula (1) or (3), and the anion according to the present invention. Accordingly, the increase in resistance under the environment having a low temperature near 0° C. was small and the image quality was satisfactory. On the other hand, in Comparative Example 5, in which the resin did not contain, in the molecule, at least one cation structure selected from the group consisting of the formulae (1) to (13), an increase in resistance under the low-temperature environment was observed and the occurrence of a horizontal streak was observed.

Example 26

Figure 5:
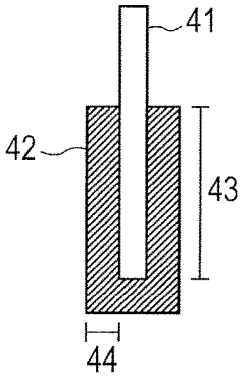
FIG. 5 is a sectional view for illustrating an example of a developing blade according to the present invention.

FIG. 5 is a sectional view of an electrophotographic member produced in this example. An SUS sheet having a thickness of 0.08 mm (manufactured by Nisshin Steel Co., Ltd.) serving as a electroconductive substrate 41 was press-cut so as to have dimensions of a length of 200 mm and a width of 23 mm. Next, the cut SUS sheet was immersed in the paint for forming a surface layer of Example 11 to form a coating film of the paint so as to have a length 43 from a longitudinal-side end of the cut SUS sheet of 1.5 mm, followed by drying. Further, the resultant was subjected to heating treatment at a temperature 140° C. for 1 hour to form a electroconductive resin layer 42 having a thickness 44 of about 10 μm on the longitudinal-side end surface of the SUS sheet. Thus, an electrophotographic member was produced.

Example 27

An electrophotographic member was produced in the same manner as in Example 26 except that the paint for forming a surface layer was changed to the one prepared in Example 21.

Comparative Example 6

An electrophotographic member was produced in the same manner as in Example 26 except that the paint for forming a surface layer was changed to the one prepared in Comparative Example 2.

(Resistance Value Evaluation)

The measurement of a resistance value of the electrophotographic members of Examples 26 and 27, and Comparative Example 6 which were left to stand under a 23° C. and 45% RH (hereinafter described as "N/N") environment was performed under the N/N environment. In addition, the measurement of a resistance value of the electrophotographic members which was left to stand under a 0° C. environment was also performed under the 0° C. environment.

The resistance measurement was performed in the same manner as the resistance measurement in Example 1 except that the roller-shaped electrophotographic member of Example 1 was changed to a developing blade member (which is the electrophotographic member of Example 26, 27, or Comparative Example 6) as shown in FIG. 5. Specifically, both longitudinal ends of the electroconductive substrate 41 of the developing blade member were each pressed with a load of 1.0 N through the intermediation of an electroconductive bearing 38 as a electroconductive resin layer of a tip portion in the developing blade member vertically abuts on the surface of a columnar metal 37.

Next, a voltage of 100 V was applied from the high-voltage power source 39, and a potential difference between both ends of a resistor having a known electrical resistance (having an electrical resistance lower than the electrical resistance of the electrophotographic member 1 by two orders of magnitude or more) placed between the columnar metal 37 and the ground was measured without rotating the columnar metal 37.

The potential difference was measured using the voltmeter 40 (189TRUE RMS MULTIMETER manufactured by Fluke Corporation). A current which had flowed through the developing blade member into the columnar metal 37 was determined by calculation based on the measured potential difference and the electrical resistance of the resistor.

The applied voltage of 100 V was divided by the resultant current to determine the electrical resistance value of the developing blade member. In the measurement of the potential difference, 2 seconds after the application of the voltage, sampling was performed for 3 seconds and a value calculated from the average value of the sampled data was defined as an initial resistance value.

<Evaluation as Developing Blade>

(Regulation Failure Evaluation)

The electrophotographic member serving as an evaluation object was mounted as a developing blade onto a laser printer having the construction illustrated in FIG. 3 (trade name: LBP7700C; manufactured by Canon Inc.). The laser printer was placed and left to stand for 2 hours or more under a 0° C. environment, and then a black image having a print percentage of 1% was continuously output on 100 sheets. After that, a white solid image was output on fresh copy paper. After the output of those images, the state of a toner coat on the surface of the developing member was observed, and the presence or absence of electrostatic aggregation of toner (regulation failure) due to abnormality in charging of toner was visually observed. The result of the observation was evaluated by the following criteria.

A: No regulation failure is present on the toner coat.

B: A regulation failure is present on the toner coat, but does not appear in the image.

C: A regulation failure appears in the image.

TABLE 9

| | Ionic compound | Number of crosslinking points between ionic compound and urethane | N/N resistance (Ω) | 0° C. resistance (Ω) | (0° C. resistance)/(N/N resistance) | 0° C. regulation failure |
|---|---|---|---|---|---|---|
| Example 26 | IP-11 | 2 | $9.10 \times 10^6$ | $3.09 \times 10^8$ | 34.0 | A |
| Example 27 | IP-21 | 3 | $2.05 \times 10^6$ | $3.66 \times 10^7$ | 17.9 | A |
| Comparative Example 6 | IP-25 | 2 | $6.13 \times 10^8$ | $8.83 \times 10^{10}$ | 144.0 | C |

In each of Examples 26 and 27, the electroconductive resin layer contained the resin having, in the molecule, at least one cation structure selected from the group consisting of the formulae (1) to (13), and the anion according to the present invention, and hence no regulation failure occurred under the 0° C. environment. On the other hand, in Comparative Example 6, a regulation failure occurred. The regulation failure under the 0° C. environment occurred probably as a result of non-uniform charging of toner caused by an increase in resistance of the developing blade, the increase preventing the application of a blade bias to a specified value.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-266046, filed Dec. 26, 2014, which is hereby incorporated by reference herein in its entirety.

What is claimed is:

1. An electrophotographic member, comprising:

an electroconductive substrate; and an electroconductive resin layer on the electroconductive substrate, wherein the electroconductive resin layer contains:

a resin having, in a molecule, at least one cation structure selected from the group consisting of the following formulae (1) to (13) and (29); and an anion, and wherein the anion comprises at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis (oxalato)borate anion:

(1)

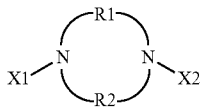

(2)

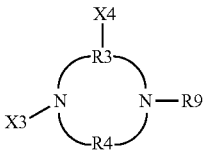

-continued (3)

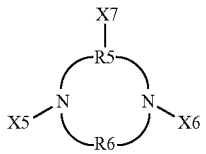

(4)

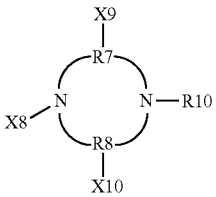

in the formulae (1) to (4):

R1 to R8 each independently represent a hydrocarbon group needed for a nitrogen-containing heterocycle in each of the formulae (1) to (4) to form a five-membered ring, a six-membered ring, or a seven-membered ring;

R9 and R10 each independently represent a hydrogen atom or a hydrocarbon group having 1 or more and 4 or less carbon atoms; and one of two N's represents $N^+$;

(5)

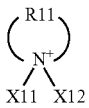

(6)

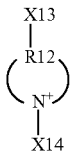

(7)

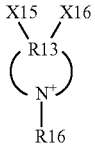

(8)

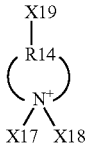

(9)

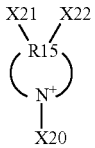

in the formulae (5) to (9):

R11 to R15 each independently represent a hydrocarbon group needed for a nitrogen-containing heterocycle in each of the formulae (5) to (9) to form a five-membered ring, a six-membered ring, or a seven-membered ring; and R16 represents a hydrogen atom or a hydrocarbon group having 1 or more and 4 or less carbon atoms;

(10)

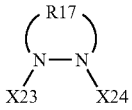

(11)

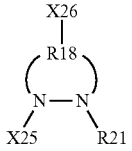

-continued (12)

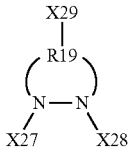

(13)

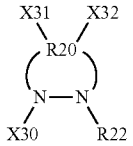

(29)

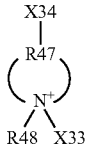

in the formulae (10) to (13) and (29):

R17 to R20 and R47 each independently represent a hydrocarbon group needed for a nitrogen-containing heterocycle in each of the formulae (10) to (13) and (29) to form a five-membered ring, a six-membered ring, or a seven-membered ring;

R21, R22, and R48 each independently represent a hydrogen atom or a hydrocarbon group having 1 or more and 4 or less carbon atoms; and in the formulae (10) to (13), one of two N's represents $N^+$;

in the formulae (1) to (13) and (29):

X1 to X34 each independently represent a structure represented by the following formula (A), (b), or (c):

Formula (A)

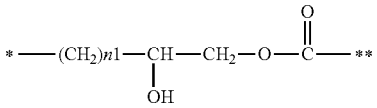

Formula (b)

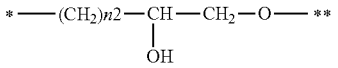

Formula (c)

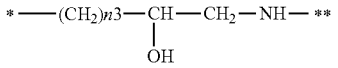

in the formula (A), (b), or (c):

symbol "*" represents a bonding site with a nitrogen atom in the nitrogen-containing heterocycle or a carbon atom in the nitrogen-containing heterocycle in the formulae (1) to (13) and (29);

symbol "**" represents a bonding site with a carbon atom in a polymer chain of the resin; and n1, n2, and n3 each independently represent an integer of 1 or more and 4 or less.

2. An electrophotographic member according to claim 1, wherein the resin has, in the molecule, at least one cation structure selected from the formulae (3), (4), (8), (9), (12), (13), and (29).

3. An electrophotographic member according to claim 1, wherein the structure represented by the formula (1) or the formula (2) comprises a structure represented by the following formula (1-1) or the following formula (2-1), respectively Formula (1-1)

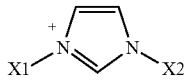

Formula (2-1)

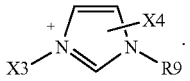

4. An electrophotographic member according to claim 1, wherein the structure represented by the formula (3) comprises a structure represented by the following formula (3-1)

Formula (3-1)

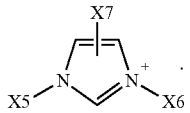

5. An electrophotographic member according to claim 1, wherein the structure represented by the formula (5) comprises a structure represented by the following formula (5-1)

Formula (5-1)

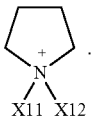

6. An electrophotographic member according to claim 1, wherein the structure represented by the formula (6) or the formula (7) comprises a structure represented by the following formula (6-1) or the following formula (7-1), respectively Formula (6-1)

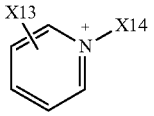

Formula (7-1)

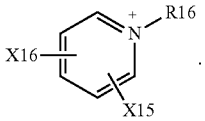

7. An electrophotographic member according to claim 1, wherein the structure represented by the formula (8) comprises a structure represented by the following formula (8-1)

Formula (8-1)

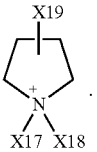

8. An electrophotographic member according to claim 1, wherein the structure represented by the formula (10) or the formula (11) comprises a structure represented by the following formula (10-1) or the following formula (11-1), respectively Formula (10-1)

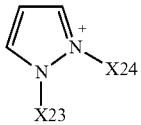

Formula (11-1)

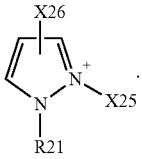

9. An electrophotographic member according to claim 1, wherein the structure represented by the formula (29) comprises a structure represented by the following formula (29-1)

Formula (29-1)

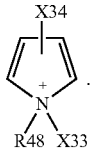

10. An electrophotographic member, comprising:

an electroconductive substrate; and an electroconductive resin layer on the electroconductive substrate, wherein the electroconductive resin layer contains a resin comprising a reaction product between an ionic compound having at least one cation selected from the group consisting of the following formulae (14) to (26) and (28), and a compound capable of reacting with a glycidyl group:

(14)

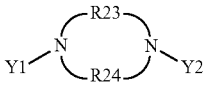

(15)

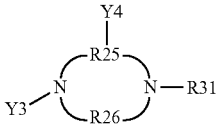

(16)

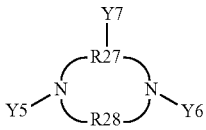

(17)

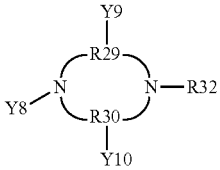

in the formulae (14) to (17):

R23 to R30 each independently represent a hydrocarbon group needed for a nitrogen-containing heterocycle in each of the formulae (14) to (17) to form a five-membered ring, a six-membered ring, or a seven-membered ring;

R31 and R32 each independently represent a hydrogen atom or a hydrocarbon group having 1 or more and 4 or less carbon atoms; and one of two N's represents $N^+$;

(18)

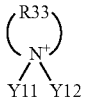

(19)

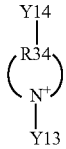

(20)

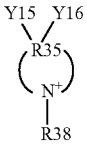

(21)

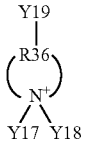

(22)

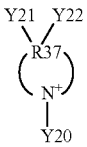

in the formulae (18) to (22):

R33 to R37 each independently represent a hydrocarbon group needed for a nitrogen-containing heterocycle in each of the formulae (18) to (22) to form a five-membered ring, a six-membered ring, or a seven-membered ring; and R38 represents a hydrogen atom or a hydrocarbon group having 1 or more and 4 or less carbon atoms;

(23)

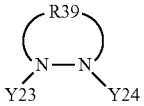

(24)

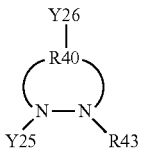

-continued (25)

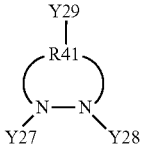

(26)

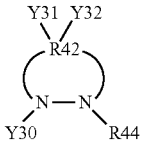

(28)

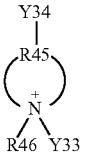

in the formulae (23) to (26) and (28):

R39 to R42 and R45 each independently represent a hydrocarbon group needed for a nitrogen-containing heterocycle in each of the formulae (23) to (26) and (28) to form a five-membered ring, a six-membered ring, or a seven-membered ring;

R43, R44, and R46 each independently represent a hydrogen atom or a hydrocarbon group having 1 or more and 4 or less carbon atoms; and in the formulae (23) to (26), one of two N's represents $N^+$; and in the formulae (14) to (26) and (28):

Y1 to Y34 each independently represent a structure represented by the following formula (27):

(27)

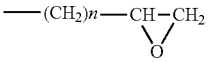

in the formula (27), n represents an integer of 1 or more and 4 or less.

11. An electrophotographic member according to claim 10, wherein the ionic compound comprises at least one anion selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion.

12. A process cartridge, which is removably mounted onto a main body of an electrophotographic apparatus, the process cartridge comprising at least one electrophotographic member comprising:

an electroconductive substrate; and an electroconductive resin layer on the electroconductive substrate, wherein the electroconductive resin layer contains:

a resin having, in a molecule, at least one cation structure selected from the group consisting of the following formulae (1) to (13) and (29); and an anion, and wherein the anion comprises at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion:

(1)

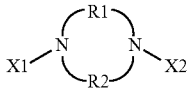

(2)

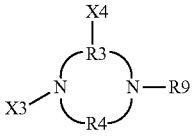

(3)

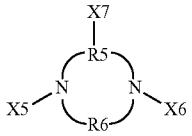

(4)

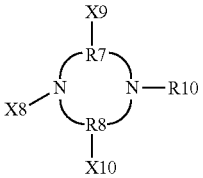

in the formulae (1) to (4):

R1 to R8 each independently represent a hydrocarbon group needed for a nitrogen-containing heterocycle in each of the formulae (1) to (4) to form a five-membered ring, a six-membered ring, or a seven-membered ring;

R9 and R10 each independently represent a hydrogen atom or a hydrocarbon group having 1 or more and 4 or less carbon atoms; and one of two N's represents $N^+$;

(5)

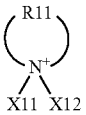

(6)

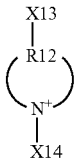

(7)

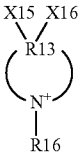

-continued (8)

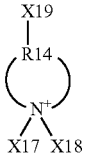

(9)

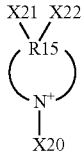

in the formulae (5) to (9):

R11 to R15 each independently represent a hydrocarbon group needed for a nitrogen-containing heterocycle in each of the formulae (5) to (9) to form a five-membered ring, a six-membered ring, or a seven-membered ring; and R16 represents a hydrogen atom or a hydrocarbon group having 1 or more and 4 or less carbon atoms;

(10)

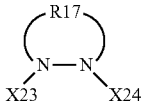

(11)

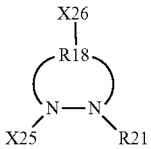

(12)

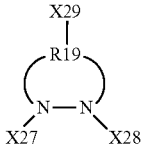

(13)

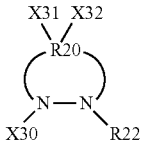

(29)

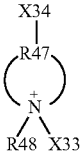

in the formulae (10) to (13) and (29):

R17 to R20 and R47 each independently represent a hydrocarbon group needed for a nitrogen-containing heterocycle in each of the formulae (10) to (13) and (29) to form a five-membered ring, a six-membered ring, or a seven-membered ring;

R21, R22, and R48 each independently represent a hydrogen atom or a hydrocarbon group having 1 or more and 4 or less carbon atoms; and in the formulae (10) to (13), one of two N's represents $N^+$;

in the formulae (1) to (13) and (29):

X1 to X34 each independently represent a structure represented by the following formula (A), (b), or (c):

Formula (A)

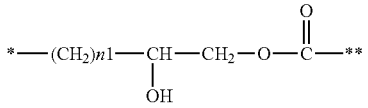

Formula (b)

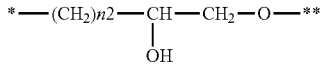

Formula (c)

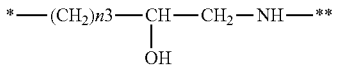

in the formula (A), (b), or (c):

symbol "*" represents a bonding site with a nitrogen atom in the nitrogen-containing heterocycle or a carbon atom in the nitrogen-containing heterocycle in the formulae (1) to (13) and (29);

symbol "**" represents a bonding site with a carbon atom in a polymer chain of the resin; and n1, n2, and n3 each independently represent an integer of 1 or more and 4 or less.

13. An electrophotographic apparatus, comprising:

an electrophotographic photosensitive member; and at least one electrophotographic member comprising:

an electroconductive substrate; and an electroconductive resin layer on the electroconductive substrate, wherein the electroconductive resin layer contains:

a resin having, in a molecule, at least one cation structure selected from the group consisting of the following formulae (1) to (13) and (29); and an anion, and wherein the anion comprises at least one selected from the group consisting of a fluorinated sulfonylimide anion, a fluorinated alkylsulfonylimide anion, a fluorinated sulfonyl methide anion, a fluorinated alkylsulfonyl methide anion, a fluorinated sulfonate anion, a fluorinated alkylsulfonate anion, a fluorinated carboxylate anion, a fluorinated borate anion, a fluorinated phosphate anion, a fluorinated arsenate anion, a fluorinated antimonate anion, a dicyanamide anion, and a bis(oxalato)borate anion:

(1)

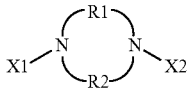

(2)

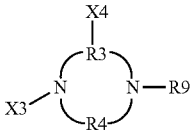

(3)

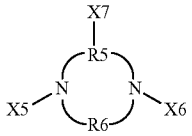

-continued (4)

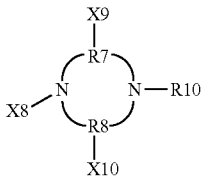

in the formulae (1) to (4):

R1 to R8 each independently represent a hydrocarbon group needed for a nitrogen-containing heterocycle in each of the formulae (1) to (4) to form a five-membered ring, a six-membered ring, or a seven-membered ring;

R9 and R10 each independently represent a hydrogen atom or a hydrocarbon group having 1 or more and 4 or less carbon atoms; and one of two N's represents $N^+$;

(5)

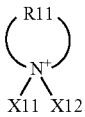

(6)

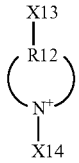

(7)

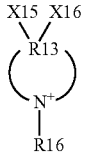

(8)

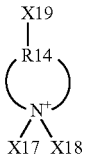

(9)

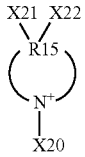

in the formulae (5) to (9):

R11 to R15 each independently represent a hydrocarbon group needed for a nitrogen-containing heterocycle in each of the formulae (5) to (9) to form a five-membered ring, a six-membered ring, or a seven-membered ring; and R16 represents a hydrogen atom or a hydrocarbon group having 1 or more and 4 or less carbon atoms;

(10)

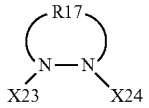

(11)

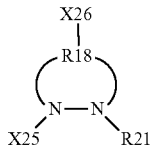

(12)

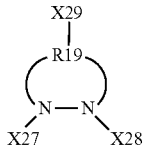

(13)

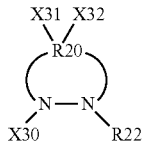

(29)

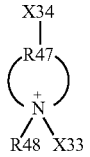

in the formulae (10) to (13) and (29):

R17 to R20 and R47 each independently represent a hydrocarbon group needed for a nitrogen-containing heterocycle in each of the formulae (10) to (13) and (29) to form a five-membered ring, a six-membered ring, or a seven-membered ring;

R21, R22, and R48 each independently represent a hydrogen atom or a hydrocarbon group having 1 or more and 4 or less carbon atoms; and in the formulae (10) to (13), one of two N's represents $N^+$;

in the formulae (1) to (13) and (29):

X1 to X34 each independently represent a structure represented by the following formula (A), (b), or (c):

Formula (A)

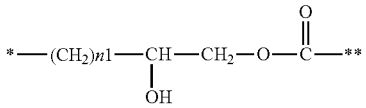

Formula (b)

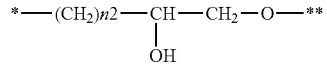

Formula (c)

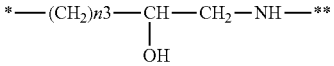

in the formula (A), (b), or (c):

symbol "*" represents a bonding site with a nitrogen atom in the nitrogen-containing heterocycle or a carbon atom in the nitrogen-containing heterocycle in the formulae (1) to (13) and (29);

symbol "**" represents a bonding site with a carbon atom in a polymer chain of the resin; and n1, n2, and n3 each independently represent an integer of 1 or more and 4 or less.

* * * * *